United States Patent [19]

Iwaki et al.

[11] Patent Number: 4,736,725

[45] Date of Patent: Apr. 12, 1988

[54] FUEL INJECTION SYSTEM FOR INTERNAL COMBUSTION ENGINE

[75] Inventors: Masato Iwaki, Higashihiroshima; Masami Nakao, Hiroshima, both of Japan

[73] Assignee: Mazda Motor Corporation, Hiroshima, Japan

[21] Appl. No.: 60,340

[22] Filed: Jun. 10, 1987

[30] Foreign Application Priority Data

Jun. 12, 1986 [JP] Japan ..... 61-136805
Jun. 19, 1986 [JP] Japan ..... 61-143854

[51] Int. Cl.[4] ..... F02M 51/00

[52] U.S. Cl. ..... 123/480; 123/492; 123/493; 123/494; 364/431.05

[58] Field of Search ..... 123/478, 480, 486, 492, 123/493, 494; 364/431.05

[56] References Cited

U.S. PATENT DOCUMENTS

| | | | |
|---|---|---|---|
| 4,528,960 | 7/1985 | Mizuno et al. | 123/478 |
| 4,541,388 | 9/1985 | Ujihashi et al. | 123/486 |
| 4,562,814 | 1/1986 | Abo et al. | 123/494 X |
| 4,644,474 | 2/1987 | Aposchanski et al. | 123/494 X |
| 4,664,090 | 5/1987 | Kabasin | 123/494 |

FOREIGN PATENT DOCUMENTS 0007017 1/1984 Japan .

*Primary Examiner*—Willis R. Wolfe
*Attorney, Agent, or Firm*—Fleit, Jacobson, Cohn & Price

[57] ABSTRACT

A fuel injection system for an internal combustion engine comprises a fuel injecting valve, L-jetronic calculating means for calculating the amount of fuel to be injected based upon the output from an air flow meter under an engine operating condition where the amount of intake air is small, D-jetronic calculating means for calculating the amount of fuel to be injected based upon outputs from engine load detecting means and engine rpm detecting means under an engine operating condition where the amount of intake air is large and correcting means for correcting the amount of fuel to be injected upon switchover between the L-jetronic and D-jetronic calculating means in response to engine operating condition changes. As a result, the difference between successive amounts of fuel to be injected is never large. of fuel injected lastly. According to the present invention, it is possible to control the air-flow ratio to the optimum value when the method for calculating the amount of fuel to be injected changes between the L-jetronic method and the D-jetronic method in response to engine operating condition changes, even during an acceleration or deceleration.

14 Claims, 11 Drawing Sheets

FUEL INJECTION SYSTEM FOR INTERNAL COMBUSTION ENGINE

BACKGROUND OF THE INVENTION

The present invention relates to a fuel injection system for an internal combustion engine, and more particularly to such a fuel injection system in which the amount of fuel to be injected is controlled in accordance with the output of an air flow meter, or the negative intake pressure or a throttle valve opening.

DESCRIPTION OF PRIOR ART

As methods for obtaining a target value for electrically controlling the amount of fuel to be injected in an internal combustion engine, there are known an L-jetronic method by which an amount of fuel to be injected is calculated based upon the amount of intake air detected by an air flow meter and a D-jetronic method by which the amount of fuel is to be injected is calculated based upon the amount of intake air calculated in accordance with the pressure at a portion downstream of a throttle valve in an intake passage or the degree of opening of the throttle valve, and the engine rpm. It is known that although air flow meter can accurately detect the amount of intake air under the state of engine operating condition is such that the amount of intake air is small, it is difficult for an air flow meter to detect the amount of intake air with high accuracy when the amount of intake air is large because of pulsation of intake air etc. It is also known that although it is possible to accurately determine the amount of intake air based upon the pressure at a portion downstream of the throttle valve or the throttle valve opening when the amount of intake air is large, it is difficult to accurately determine the amount of intake air based on either of these factors when the amount of intake air is small. Therefore, the L-jetronic method is suitable for obtaining a target value for controlling the amount of fuel to be injected under an operating condition wherein the amount of intake air is small and the D-jetronic method is suitable for obtaining the target value under an operating condition wherein the amount of intake air is large.

Japanese Patent Publication No. 7017/1984 discloses a control system for controlling the amount of fuel to be injected which uses the aforesaid two methods in combination. Namely, in the disclosed control system, the the target value for controlling the amount of fuel to be injected is obtained in accordance with the L-jetronic method under operating conditions wherein the amount of intake air is less than a predetermined value and is obtained in accordance with the D-jectronic method under operating conditions wherein the amount of intake air is not less than the predetermined value. According to this prior art system, it is possible to calculate the desired amount of fuel with high accuracy over a wide range of engine operating conditions so that that air-fuel ratio can be controlled in an optimum manner.

However, according to this prior art system, the air-fuel ratio inevitably suddenly changes when the calculating method for calculating the target value of the amount of fuel to be injected is changed between the L-jetronic method and the D-jetronic method in response to changes in the engine operating condition changes, since the calculated amounted of fuel are different between the two methods even under the same engine operating conditions. As a result, when the calculating method is switched over an undesirable change of an engine rpm occurs suddenly, often causing a torque shock.

Further, since the response of the prior art fuel injection system to change in engine operating condition is inevitably delayed during transient engine operating condition such as during acceleration or deceleration, the amount of fuel injected is always one calculated in accordance with an engine operating condition some time earlier. Therefore, it is impossible to inject the optimum amount of fuel during transient engine operating condition or to prevent torque shock.

SUMMARY OF THE INVENTION

It is therefore an object of the present invention to provide a fuel injection system for an internal combustion engine which is capable of smoothly changing the engine operating condition even when the target value calculating method for calculating the amount of fuel to be injected is changed between the L-jetronic method and the D-jetronic method, and which is capable of preventing torque shock.

It is a further object of the present invention to provide a fuel injection system for an internal combustion engine which is capable of smoothly changing the engine operating condition even when the target value calculating method for calculating the amount of fuel to be injected is changed between the L-jetronic method and the D-jetronic method during transent engine operating condition and which is capable of preventing torque shock.

According to the present invention, the above and other objects can be accomplished by a fuel injection system for an internal combustion engine having an air flow meter provided in an intake passage for detecting an amount of intake air, engine load detecting means for detecting an engine load based upon a pressure at a portion downstream of a throttle valve in the intake passage or an opening of the throttle valve, and engine rpm detecting means, said fuel injection system comprising fuel injecting means, first calculating means for calculating an amount of fuel to be injected by said fuel injecting means based upon an output from said air flow meter under an engine operating condition where the amount of intake air is small, second calculating means for calculating an amount of fuel to be injected by said fuel injecting means based upon outputs from said engine load detecting means and said engine rpm detecting means under an engine operating condition where the amount of intake air is large, and said engine rpm detecting means and correcting means for correcting said calculated amount of fuel to be injected upon switchover between said first and second calculating means in response to changes in the engine operating condition changes, whereby the difference between successive amounts of fuel to be injected is never large.

In a preferred aspect of the present invention, said fuel injection system further includes transient condition correcting means for producing a correction value for correcting the amount of fuel to be injected calculated by said first calculating means and/or said second calculating means during acceleration or deceleration.

The above and other objects and features of the present invention will become apparent from the following description made with reference to the accompanying drawings.

DESCRIPTION OF THE PREFERRED EMBODIMENT

Figure 1:
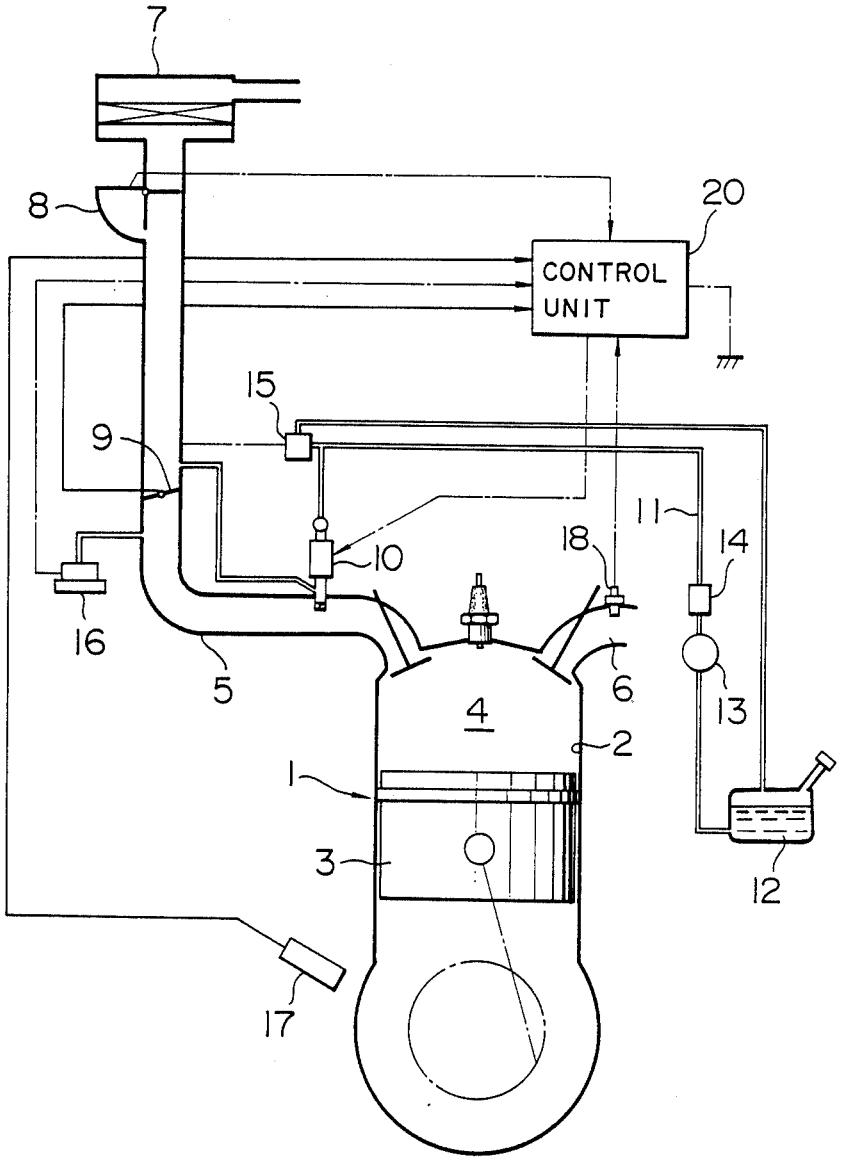
FIG. 1 is a schematic drawing showing an internal combustion engine having a fuel injection system which is an embodiment of the present invention.

Referring to FIG. 1, an internal combustion engine 1 is provided with a piston 3 reciprocating in a cylinder bore 2 and a space above the piston 3 constitutes a combustion chamber 4 into which an intake passage 5 and an exhaust passage 6 are open. In the intake passage 5, there are provided an air chamber 7, an air flow meter 8 for detecting the amount of intake air, a throttle valve 9 whose opening is controlled in accordance with the position of an accelerator pedal, and a fuel injection valve 10 is connected with a fuel passage 11 communicated with a fuel tank 12 and the fuel passage is provided with a fuel pump 13, a filter 14 and a pressure regulator 15.

Further, there are provided a boost sensor 16 for detecting negative intake pressure at a portion downstream of the throttle valve 9 in the intake passage 5, an engine rpm sensor 17 for detecting engine rpm and an oxygen concentration sensor 18 for detecting the oxygen concentration in exhaust gas. Output signals from the air flow meter 8, the boost sensor 16, the engine rpm sensor 17 and the oxygen concentration sensor 18 are input to a control unit 20 which preferably comprises a microcomputer. The control unit 20 calculates the amount of fuel to be injected based upon these input signals so that the air-fuel ratio can be controlled to an optimum value and outputs a control signal to the fuel injection valve control means (not shown) to control the opening period of the fuel injection valve 10.

Figure 2:
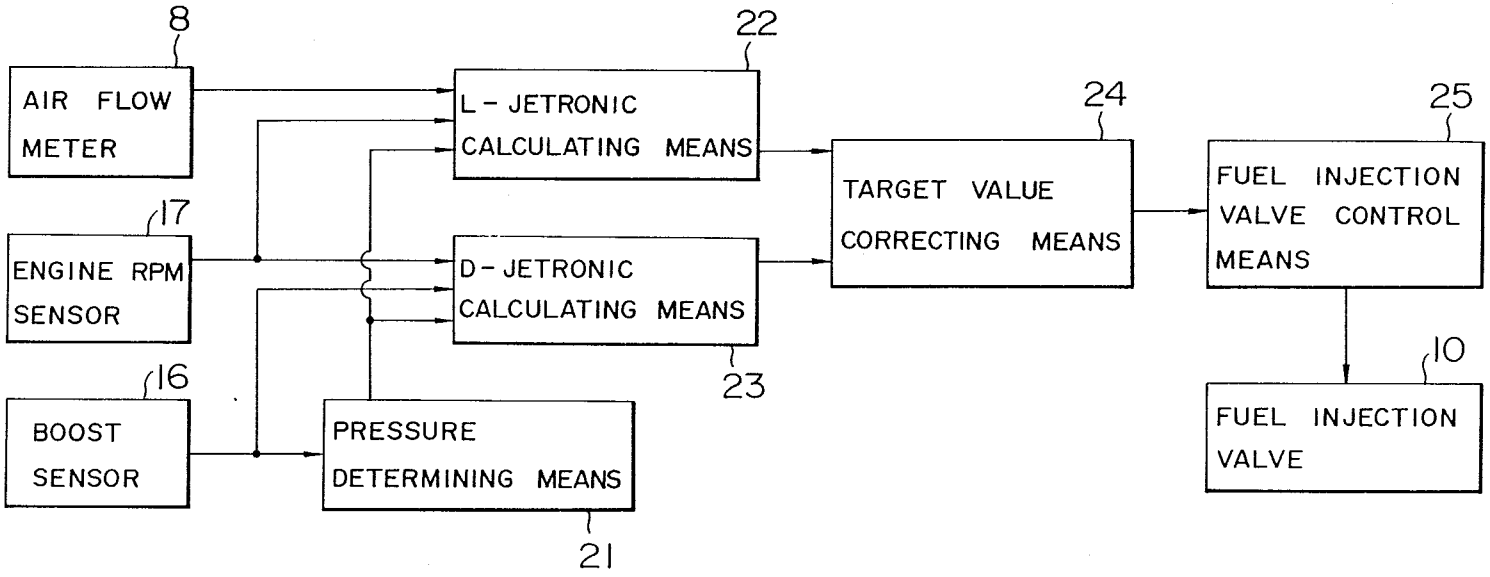
FIG. 2 is a block diagram showing a fuel injection system for an internal combustion engine which is an embodiment of the present invention.

FIG. 2 is a block diagram showing a fuel injection system provided in the control unit 20, which is an embodiment of the present invention. There are provided in the fuel injection system a pressure determining means 21 for judging whether a pressure P detected by the boost sensor 16 is less than a predetermined pressur P0 and outputting an command signal to a L-jetronic calculating means 22 if the pressure P is less than the predetermined pressure P0 and to a D-jetronic calculating means 23 if the pressure is not less than the predetermined pressure P0, the L-jetronic calculating means 22 for calculating a target value for control of the amount of fuel to be injected by the L-jetronic method and outputting the calculated target value to a target value correcting means 24 only when the command signal is input from the pressure determining means 21, the D-jetronic calculating means 23 for calculating a target value for control of the amount of fuel to be injected by the D-jetronic method and outputting the calculated target value to the target value correcting means only 24 when the command signal is input from the pressure determining means 21, the target value correcting means 24 for correcting the target value input from either the L-jetronic calculating means 22 or the D-jetronic calculating means 23 in accordance with an engine operating condition and a fuel injection valve control means 25 for controlling the opening period of the fuel injection valve 10 in accordance with an output signal from the target value correcting means 24. The pressure determining means 21 receives the output signal representing the pressure at the portion downstream of the throttle valve 9 from the boost sensor 16 and judges whether the pressure P is less than the predetermined pressure P0 and outputs the command signal to the L-jetronic calculating means 21 when the pressure is less than the predetermined pressure P0 and outputs the command signal to the D-jetronic calculating means 23 when the pressure P is not less than the predetermined pressure P0. The L-jetronic calculating means 22 receives the output signals from the air flow meter 8 and the engine rpm sensor 17 and only when it further receives the command signal from the pressure determining means 21, it calculates a target value for control of the amount of fuel to be injected by the L-jetronic method based upon the output signals from the air flow meter 8 and the engine rpm sensor 17, and outputs the calculated target value to the target value correcting means 24. The D-jetronic calculating means 23 receives the output signals from the engine rpm sensor 17 and the boost sensor 16 and only when it further receives the command signal from the pressure determining means 21, it calculates a target value for control of the amount of fuel to be injected by the D-jetronic method based upon the signals from the engine rpm sensor 17 and the boost sensor 16 and outputs the calculated target value to the target value correcting means 24. Therefore, the target value correcting means 24 receives a signal representing the target value from the L-jetronic calculating means 22 when the pressure P detected by the boost sensor 16 is less than the predetermined pressure P0 and that from the D-jetronic calculating means 23 when the pressure P is not less than the predetermined pressure P0. When the target value calculating method is changed between the L-jetronic method and the D-jetronic method in response to changes in the engine operating condition, the target value correcting means 24 corrects the input target value so that the target value for controlling the amount of fuel to be injected can be gradually changed from the value calculated just before the change of the calculating method to that just after the change of the calculating method during a predetermined period after the target value calculating method is changed.

Figure 3:
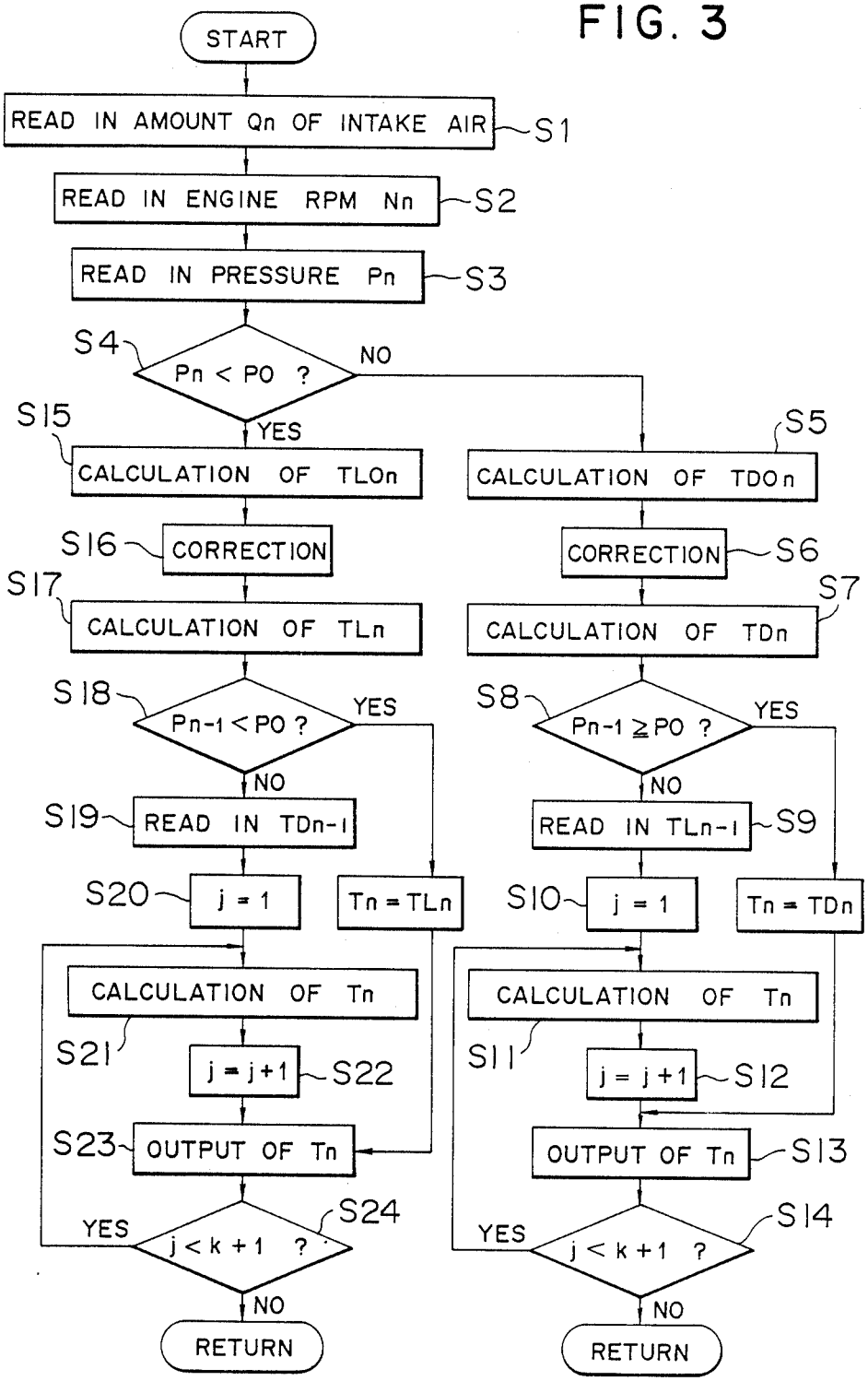
FIG. 3 is a flow chart showing an example of a method for controlling the amount of fuel to be injected in the embodiment of the fuel injection system of the present invention shown in FIG. 2.

FIG. 3 shows a flow chart for controlling the amount of fuel to be injected in the fuel injection system shown in FIGS. 1 and 2. As shown in FIG. 3, at steps S1 to S3, an amount Qn of intake air detected by the air flow meter 8, an engine rpm Nn detected by the engine rpm sensor 17 and a pressure Pn at the portion downstream of the throttle valve 9 in the intake passage 5 detected by the boost sensor 16 are respectively read into the control unit 20 as described above. Then, at a step S4, the pressure determining means 21 judges whether or not the detected pressure Pn is less than the predetermined pressure P0. If the detected pressure Pn is less than the predetermined pressure P0, the pressure determining means 21 outputs an command signal to the L-jetronic calculating means 22 and the L-jetronic calculating means 22 calculates the target value for controlling the amount of fuel to be injected in the form of the opening period of the fuel injection valve 10 by the L-jetronic method at steps S15 to S17. On the contrary, if the detected pressure Pn is not less than the predetermined pressure P0, the pressure determining means 21 outputs the command signal to the D-J calculating means 23 and the D-J calculating means 23 calculates the target value by the D-jetronic method at steps S5 to S7.

More specifically, under a engine operating condition where the detected pressure Pn is less than the predetermined pressure P0 and where the amount of intake aiar is considered to a small, the L-J calculating means 22 calculates the target value for controlling the amount of fuel to be injected in the form of the opening period of the fuel injection valve 10 in accordance with the L-jetronic method in the steps S15 to S17.

At first, a standard amount TL0n of fuel to be injected is calculated at a step S15 in terms of the opening period of the fuel injection valve 10, using the following formula which is based upon the amount Qn/Nn of intake air per rpm, a constant coefficient K and an intake air temperature correction coefficient Cai.

$$TL0n = K \times (Qn/Nn) \times Cai$$

Then, at a step S17, the amount TLn of fuel to be injected, that is, the target value for controlling the amount of fuel to be injected, is calculated by correcting the standard amount TL0n using a cooling water temperature correction coefficient Cwn, an acceleration correction coefficient Cacn, an engine operation zone correction coefficent Czn for correcting the amount of fuel to be injected for such specific engine operating conditions as a heave load condition, and a battery voltage correction coefficient tbn etc. obtained based upon signals detected by the respective detecting means (not shown) at a step S16. Specifically, the target value TLn is calculated as $$TLn = TL0n \times (1 + Cwn + Cacn + Czn + \ldots) + tbn$$

The obtained target value TLn is output to the target value correcting means 24.

On the contrary, under an engine operating condition where the detected pressure Pn is not less than the predetermined pressure P0, the D-jetronic calculating means 23 calculates the target value for controlling the amount TDn of fuel to be injected by the D-jetronic method in terms of the opening period of the fuel injection valve 10 in accordance with the following steps. At first, at the step S5, a standard amount TD0n of fuel to be injected is calculated by the following formula based upon mapped amounts F(Nn,Pn) of fuel to be injected experimentally determined as a function of the engine rpm Nn and the pressure Pn, and the mapped values being stored in the D-jetronic calculating means 23.

$$TD0n = F(Nn, Pn) \times Cai$$

Then, various correction coefficients are calculated at a step S6 and the amount TDn of fuel to be injected is calculated using the correction coefficient at a step S7 in the same manner as that described in connection with the calculation in the L-jetronic calculating means. The obtained target value TDn is output to the target value correcting means 24.

Subsequently, at a step S8 or S18, the target value correcting means 24 judges whether the target value calculating method has been changed between the preceding control cycle and the current control cycle by comparing the pressure Pn-1 at the portion downstream of the throttle valve 9 detected during the preceding control cycle with the predetermined pressure P0.

At the step S8, when it is judged that the pressure Pn-1 at the portion downstream of the throttle valve 9 detected in the preceding control cycle is not less than the predetermined pressure P0, since the target value was calculated by the D-jetronic method both in the preceding control cycle and in the current control cycle and the target value TDn calculated in the current control cycle is not so different from the target value TDn-1 calculated and output in the preceding control cycle, the target value correcting means 24 outputs the target value TDn calculated at the step S7 of the current control cycle as the target value Tn to the fuel injection valve control means 25 for controlling the opening period of the fuel injection valve 10 without correcting it at a step S13. On the contrary, when it is judged that the pressure Pn-1 at the portion downstream of the throttle valve 9 detected in the preceding control cycle is less than the predetermined pressure P0, it is considered that the target value calculating method has just been changed from the L-jetronic method to the D-jetronic method. Therefore, since the target value TDn calculated by the D-jetronic method in the current control cycle is probably much different from the target value TLn-1 calculated by the L-jetronic method in the preceding control cycle, if the amount of fuel to be injected is controlled in accordance with the target value TDn calculated by the D-jetronic method at the step S7 of the current control cycle, the amount of fuel injected will suddenly change between the preceding control cycle and the current control cycle and, as a result, torque shock will occur. So, in this embodiment, at steps S9 to S12, the target value correcting means 24 corrects the target value TDn calculated at the step S7 so that the amount of fuel to be injected reaches the target value TDn calculated by the D-jetronic method in the current control cycle in gradual steps during a predetermined number k of correcting cycles in a predetermined time. More specifically, the target value TLn-1 calculated by the L-jetronic method at the preceding control cycle is read in at the step S9 and the value of an operation parameter j for stepwise correcting operation to be carried out in the target value correction means 24 is initialized to be 1 at the step S10. And then, the target value TLn-1 is gradually changed in steps at the step S11 so that the target value TLn'is changed by a value (TLn'TDn)/k during each correction cycle, and the operation parameter j is increased one by one at the step S12 so that the correcting operation is completed at the kth correcting cycle. The corrected target value Tn produced in each correcting operation cycle is output to the fuel injection valve control means 25 to control the opening period of the fuel injection valve 10 at the step S13. It is judged whether the operation parameter j has become equal to the predetermined number k+1 at the step S14 and whether the predetermined time has passed since the correcting operation started. If not, the correcting operations at the steps S11 to S14 are repeated. When it is judged that the predetermined time has passed since the correcting operation started, the operation at the step S1 starts again.

On the other hand, at the step S18, when the target value correcting means 24 judges that the pressure Pn-1 at the portion downstream of the throttle valve 9 detected in the preceding control cycle is less than the predetermined pressure P0, it is considered that the target value was calculated by the L-jetronic method at the preceding control cycle and that the target value TL calculated at the current control cycle is not so different from the target value TLn-1 calculated in the preceding control cycle. The target value correcting means 24 outputs the target value TLn calculated in the current control cycle as the target value to the fuel injection valve 10 without correcting it. On the contrary, when it is judged that the pressure Pn-1 is not less than the predetermined pressure P0, it is considered that the target value was calculated by the D-jetronic method in the preceding control cycle and that the target value TLn calculated in the current cycle is probably much different from the target value TDn-1 calculated in the preceding control cycle. So, in such case, the target value correcting means 24 starts the correcting operation and corrects the target value TLn at steps S19 to S22 so that the amount of fuel to be injected reaches the target value TLn calculated by the L-jetronic method in the current control cycle by gradual steps over a predetermined number k of correcting cycles in a predetermined time, in a similar manner to the steps S9 to S12. More specifically, the target value TDn-1 calculated by the D-jetronic method in the preceding control cycle is read in at the step S19 and the value of the operation parameter j for stepwise correcting operation to be carried out in the target value correcting means 24 is initialized to be 1 at the step S20. Then, the target value TDn-1 is gradually changed in steps at the step S21 so that the target value TDn-1 is changed by a value (TDn-1−TLn)/k during eahc correcting operation cycle and the value of the operation parameter j is increased by one during each correcting operation cycle at the step S22. Thus the corrected target value Tn is output to the fuel injection valve control means 25 to control the opening period of the fuel injection valve 10 at the step S23 of each correcting operation cycle. Further, it is judged whether the operation parameter j has become equal to k+1 at the step S24 and whether the predetermined time has passed since the correcting operation started. If not, the correcting opeations at the steps S21 to S24 are repeated. When the predetermined time has passed since the correcting operation started, the operation at the step S1 starts again.

According to the above described embodiment, under an engine operating condition where the pressure Pn is less than the predetermined value P0, that is, where the amount of intake air is small, the amount of fuel to be injected is calculated by the L-jetronic method, which enables the amount of fuel to be injected to be calculated with high accuracy under such condition, and under an engine operating condition where the pressure Pn is not less than the predetermined pressure P0, in other words, where the amount of intake air is large, the amount of fuel to be injected is calaculated by the D-jetronic method, which enables the amount of fuel to be injected to be calculated with high accuracy under such condition. Therefore, it is possible to control the amount of fuel to be injected so that the air-fuel ratio can be controlled to optimum value over a wide range of engine operating conditions. Further, according to the above described embodiment, when the target value calculating method changed between the L-jetronic method and the D-jetronic method in response to changes in the engine operating condition, since the amount of fuel injected is gradually changed from the value calculated by one method in the preceding control cycle to the value calculated by the other method in the current control cycle, even if the amount of fuel to be injected calculated by one method after changing the calculating method is much different from that calculated by the other method before the change of the calculating method, it is possible to prevent the air-fuel ratio from suddenly changing so that the engine operation, e.g. the engine rpm, can be smoothly changed.

In the above described embodiment, although the correcting operation is carried out by the target value correcting means 24 when the target value calculating method is changed between the L-jetronic method and the D-jetronic method, such operation may be carried out either when the calculating method is changed from the L-jetronic method to the D-jetronic method or from the D-jetronic method to the L-jetronic method. Further, although when the target value correcting method is changed, the target value for controlling the opening period of the fuel injection value 10 just after the change of the calculating method is corrected by changing the target value calculated before the change of the calculating method by the constant value (TDn−TLn-1)/k or (TLn−TDn-1)/k at the step S11 or S21 during each correcting operation cycle, the amount of fuel to be injected at the step S13 or S23 of each correcting operation cycle may be calculated by the following formulas.

When the calculating method has been changed from the L-jetronic method to the D-jetronic method, $$Tn = TL_{n-1} + \sum_{j=1}^{k} (TD_n - TL_{n-1}) / 2^{k-j+1}$$

When the calculating method has been changed from the D-jetronic method to the L-jetronic method, $$Tn = TD_{n-1} + \sum_{j=1}^{k} (TL_n - TD_{n-1}) / 2^{k-j+1}$$

In this case, while the value obtained by the kth correcting operation cycle in the target value correcting means 24 is not equal to the target value TDn or TLn calculated in accordance with the engine operating condition in the control cycle just after the change of the calculating method, no serious problem arises since the number k is usually determined to be large so that the two values are usually very close to each other.

Figure 4:
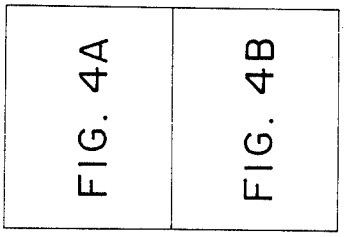
FIGS. 4, 4A, and 4B are a flow chart showing another example of a method for controlling the amount of fuel to be injected in the embodiment of the fuel injection system of the present invention shown in FIG. 2.
Figure 4A:
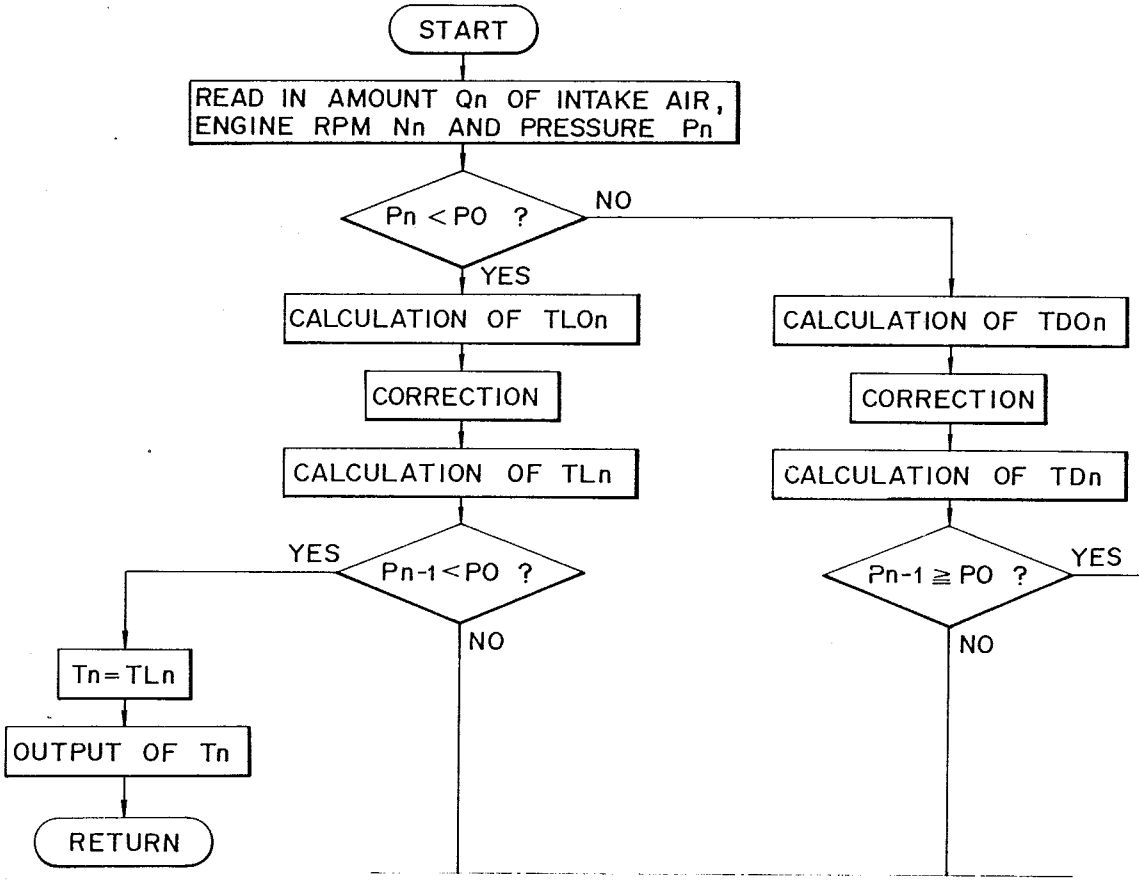
Figure 4B:
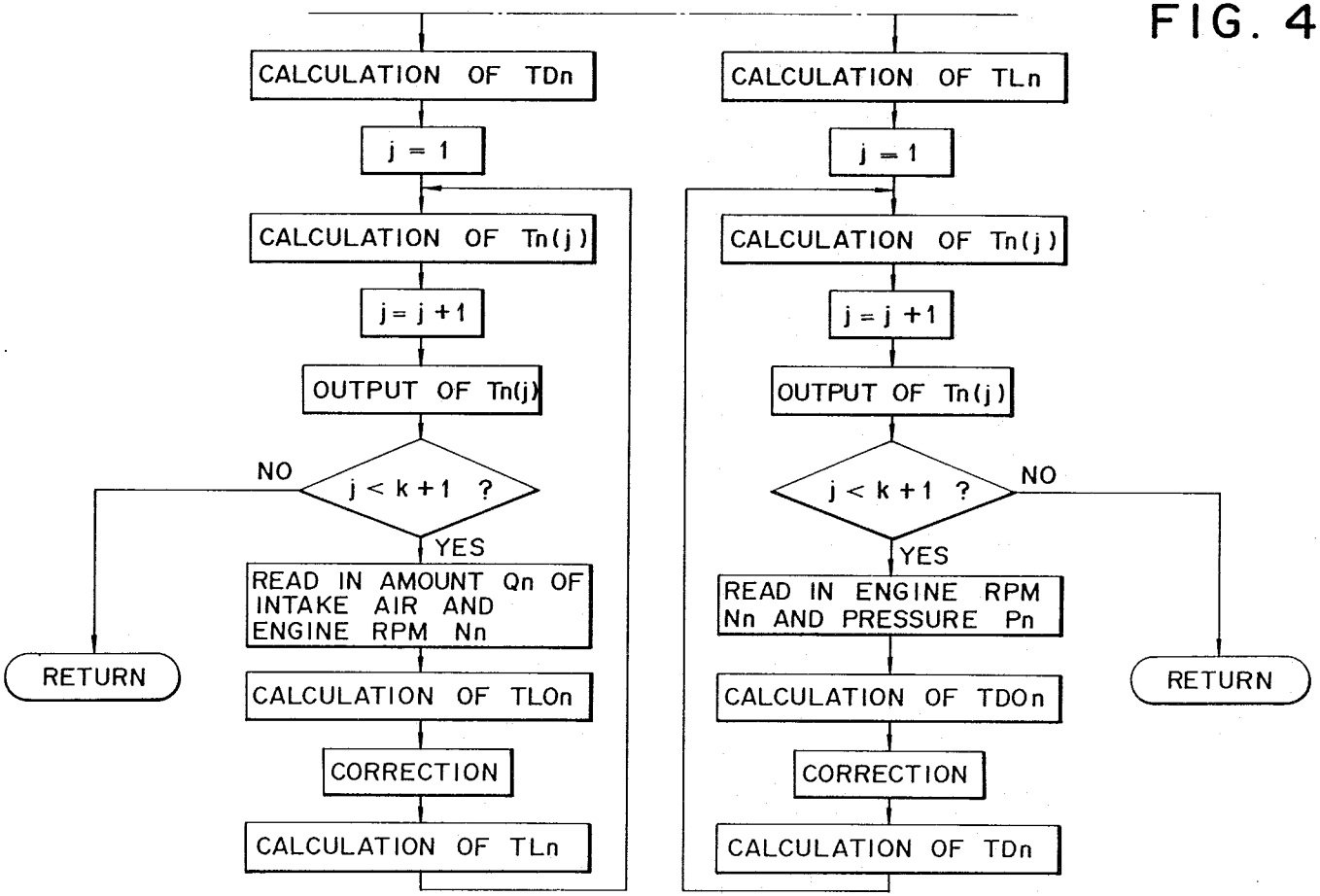

The flow chart of FIG. 4 shows another example of a control method for controlling the amount of fuel to be injected in the fuel system shown in FIG. 2.

In the control method just explained with reference to FIG. 3, the amount of fuel to be injected is controlled to gradually change over a predetermined time from the target value calculated by the one method just before the change of the calculating method to the target value calculated by the other method just after the change of the calculating method. Therefore, during the correcting operation, the engine operating condition changes from instant to instant and the amount of fuel to be injected cannot always be controlled to match the engine operating condition at each instant. In case where the engine operating condition changes considerably while the correcting operation is being completed, even if the target value calculating method is not changed in the next control cycle, the target value calculated in the next cycle can still be much different from the amount of fuel injected in the final correcting cycle and there is a risk of torque shock occurring. The embodiment shown in FIG. 4 is intended to solve this problem.

In FIG. 4, an amount of intake air Qn, an engine rpm Nn and a pressure Pn detected by the boost sensor 16 are read in and it is then judged whether the pressure Pn is less the the predetermined pressure P0 by the pressure determining means 21 in the same manner as in the previous embodiment.

If it is judged that the pressure Pn is less than the predetermined pressure P0, a standard amount TL0n of fuel to be injected is calaculated in accordance with the L-jetronic method and is then corrected using the various correction coefficients to obtain a target value TLn of the amount of fuel to be injected, in the same manner as in the previous embodiment. Then the target value correcting means 24 judges whether the pressure Pn-1 read in in the preceding control cycle was less than the predetermined pressure P0. If it was, since the amount of fuel injected in the preceding control cycle was also calculated by the L-jetronic method and the target value TLn calculated in the current control cycle is not so different from the value TLn-1 calculated in the preceding control cycle, the target value correcting means 24 outputs the target value TLn as the target value Tn to the fuel injection valve control means 25 without further correcting it to control the opening period of the fuel injection valve 10 and the control operation returns to the start. On the contrary, if the pressure Pn-1 is not less than the predetermined pressure P0, since the target value for controlling the amount of fuel to be injected in the preceding control cycle was calculated by the D-jetronic method, it is necessary to further correct the target value TLn calculated the the L-jetronic method in the current control cycle due to the change in the calculation method and the target value correcting means 24 starts the correcting operation. In such a case, at first, the target value correcting means 24 produces a second command signal and outputs it to the D-jetronic calculating means 23 which calculates the target value TDn by the D-jetronic method in accordance with the engine operating condition in this correcting operation cycle. Therefore, the block diagram of the fuel injection system shown in FIG. 2 is modified to enable implementation of the control method shown in FIG. 4. Namely, the arrangements is changed so that when the correcting operation is started, the target value correcting means 24 produces the second command signal and output it to whichever of the L-jetronic calculating means 22 and the D-jetronic calculating means 23 has not received the command signal from the pressure determining means 21 and has not calculated the target value in this control cycle, and is further changed so that the calculating means receiving the second command signal calculates the target value and outputs it to the target value correcting means 24. Then, the target value correcting means 24 calculates the amount Tn(1) of fuel to be injected in the first correcting operation cycle in terms of the opening period of the fuel injection valve 10 by correcting the target value TLn calculated by the L-jetronic method in this control cycle based upon a difference between the target values TLn and TDn calculated by the L-jetronic method and the D-jetronic method in this control cycle in accordance with the following formula so that the amount Tn(1) of fuel to be injected is gradually changed in spite of the change of the target value calculating method.

$$Tn(1)=TLn(1)+(TDn-TLn)/2$$

Subsequently, the target value correcting means 24 outputs the control signal representing the amount Tn(1) of fuel to be injected to the fuel injection valve control means 25 to control the opening period of the fuel injection valve 10. After injecting fuel, the correcting operation proceeds to a second correcting cycle and the amount of intake air Qn(2) and the engine rpm Nn(2) are read in and the L-jetronic calculating means 22 calculates the standard amount TL0n(2) of fuel to be injected based upon the amount of intake air Qn(2) and the engine rpm Nn(2) read in at this correcting operation cycle and corrects it using various correction coefficients to calculate an amount TLn(2) of fuel to be injected in the same manner as that in the first correcting operation cycle. Then, the target value correcting means corrects the target value output from the L-jetronic calculating means 22 to calculate an amount Tn(2) of fuel to be injected in the same manner as in the first correcting operation cycle and outputs a control signal representing the amount Tn(2) of fuel to be injected to the fuel injection valve control means 25. The correcting operation is repeated until a predetermined number of correcting operation cycles are completed and the predetermined time has passed since the correction operation started, and, at the jth correcting operation cycle, the amount Tn(j) of fuel to be injected is calculated by correcting the target value TLn(j) calculated by the L-jetronic method at the jth correcting operation cycle based upon the difference between the target value TLn and TDn calculated by the L-jetronic method and the D-jetronic method at the beginning of this control cycle in the target value correcting means 24 in accordance with the following formula.

$$Tn(j)=TLn(j)+(TDn-TLn)/2^j$$

When the correcting operation is completed, the operation returns to the start and the next control cycle is started.

On the other hand, when the pressure determining means 21 judges that the pressure Pn is not less than the predetermined pressure P0, the target value of the amount of fuel to be injected is calculated by the D-jetronic method in the same manner as in the previous embodiment. More specifically, a standard amount TD0n of fuel to be injected is calculated based upon mapped amounts F(Nn,Pn) of fuel to be injected experimentally determined as a function of the engine rpm Nn and the pressure Pn detected by the boost sensor 16, the mapped values being stored in the D-jetronic calculating means 23, and upon the intake air temperature coefficient Cai, and is corrected using various correction coefficients conventionally to obtain a target value TDn of the amount of fuel to be injected, in the same manner as in the previous embodiment. Then the target value correcting means 24 judges whether the pressure Pn-1 read in in the preceding control cycle was not less the predetermined pressure P0. If it was not less, since this means that the amount TDn-1 of fuel injected in the preceding control cycle was also calculated by the D-jetronic method and that the target value TDn calculated in the current control cycle is not so different from the target value TDn-1 at the preceding control cycle, the target value TDn is output as the target value Tn to the fuel injection valve control means 25 without being further corrected to control the opening period of the fuel injection valve 10, and the control operation returns to the start. On the contrary, if the pressure Pn is less than the predetermined pressure P0, since this means that the amount of fuel injected in the preceding control cycle was calculated by the L-jetronic method, it is necessary to further correct the target value TDn calculated in the current cycle due to the change of the calculation method and the target value correcting means 24 starts correcting operation. In such case, at first, the target value correcting means 24 produces the second command signal and outputs it to the L-jetronic calculating means 22 which calculates an amount TLn of fuel to be injected by the L-jetronic method in accordance with the engine operating condition in the current correcting operation cycle. Then, an amount TDn(1) of fuel to be injected in the current correcting operation cycle is calculated in terms of the opening period of the fuel injection valve 10 by correcting the target value TDn calculated by the D-jetronic method in the current control cycle based upon a difference between the target values TLn and TDn calculated by the L-jetronic method and the D-jetronic method in the current control cycle in accordance with the following formula by the target value correcting means 24 so that the amount of fuel to be injected is gradually changed over a predetermined period.

$$Tn(1)=TDn(1)+(TLn-TDn)/2$$

Subsequently, the control signal representing the amount Tn(1) of fuel to be injected is output to the fuel injection valve control means 25 and the opening period of the fuel injection valve 10 is controlled in accordance with the control signal. After injecting fuel, the engine rpm Nn(2) and the pressure Pn(2) detected by the boost sensor 16 are read into the D-jetronic calculating means 23 and the standard amount TL0n(2) of fuel to be injected is calculated based upon the map and corrected using various correction coefficients to calculate an amount Tn(2) of fuel to be injected in the same manner as in the preceding control cycle, and a control signal representing the amount Tn(2) of fuel to be injected is output to the fuel injection valve 10. The correcting operation cycle is repeated until the predetermined number of correcting operation cycles are completed, and, at a jth correcting operation cycle, the amount Tn(j) of fuel to be injected is calculated by correcting the target value TDn(j) calculated by the D-jetronic method at the jth correcting operation cycle based upon a difference between the target values TLn and TDn calculated by the L-jetronic method and the D-jetronic method at the beginning of this control cycle in the target value correcting means 24 in accordance with the following formula.

$$Tn(j)=TDn(j)+(TLn-TDn)/2^j$$

When the correcting operation has been completed, the control operation returns to the start and the next control cycle is started.

As described above, in this example, once it is judged whether the pressure Pn at the portion downstream of the throttle valve 9 is less than the predetermined pressure P0 by the pressure determining means 21 at the beginning of one control cycle and the pressure determining means 21 outputs the instruction signal to either the L-jetronic calculating means 22 or the D-jetronic calculating means 23, the pressure determining means 21 does not operate and the command signal is not renewed until the correcting operation in the control cycle is completed and whichever of the L-jetronic calculating means 22 and the D-jetronic calculating means 23 receiving the command signal produced in the pressure determining means 21 in accordance with the pressure Pn read in at the beginning of the control cycle calculates the target value TLn(j) or TDn(j) based upon the signals from the air flow meter 8 and the engine rpm sensor 17 or the engine rpm sensor 17 and the boost sensor 16 and outputs it to the target value correcting means 24 which continues the correcting operation until the predetermined time has passed. In order to enable the above described operation, the block diagram of the fuel injection system shown in FIG. 2 is further modified so that during the correcting operation, the target value correcting means 24 produces a suspension signal and outputs it to the pressure determining means 21 to suspend the operation of the pressure determining means 21.

According to the above described embodiment, since the amount of intake air Qn and the engine rpm Nn or the engine rpm Nn and the pressure Pn are read in and the target value TLn(j) or TDn(j) is calculated by the calculating method to be selected under the engine operating condition in the control cycle based upon Qn(j) and Nn(j) or Nn(j) and Pn(j) read in in each correcting operation cycle of the correcting operation and the final target value Tn(j) is obtained by correcting the target value TLn(j) or TDn(j) based upon a difference between the target values TLn and TDn calculated at the beginning of the control cycle in each correcting operation cycle of the correcting operation, it is possible to control the amount of fuel to be injected in accordance with the engine operating condition at each instant.

Figure 5:
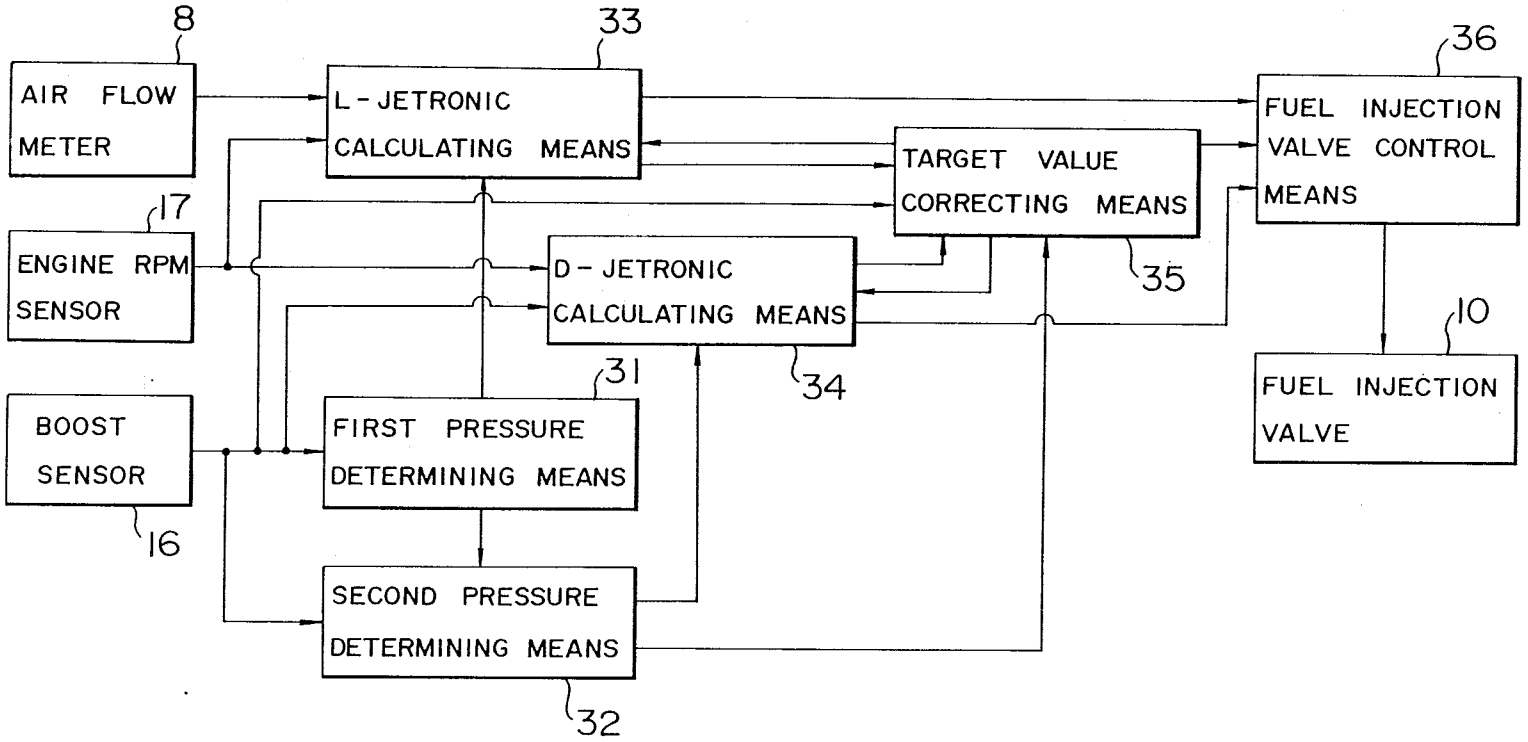
FIG. 5 is a block diagram showing a fuel injection system for an internal combustion engine which is another embodiment of the present invention.
Figure 6:
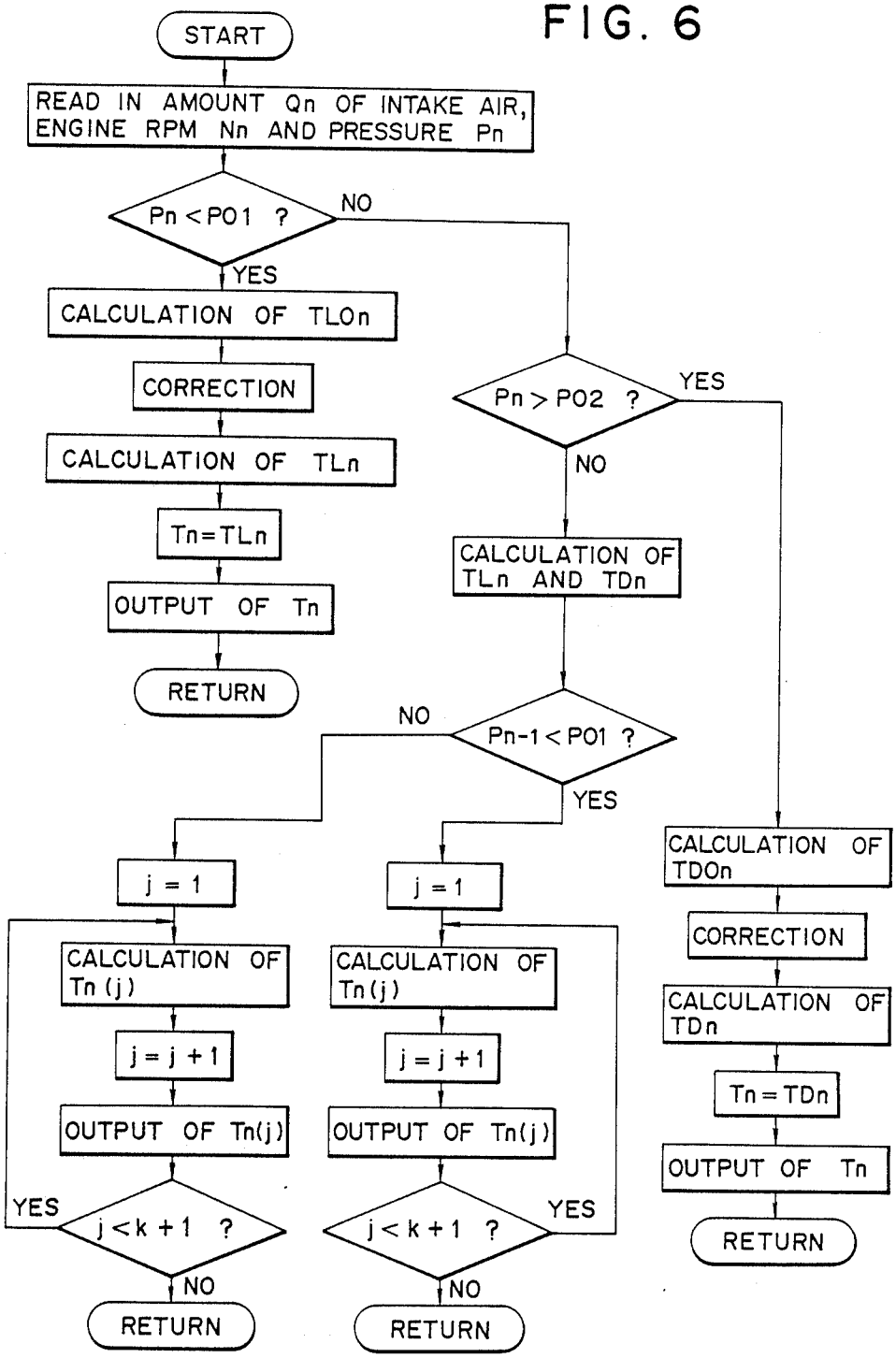
FIG. 6 is a flow chart showing an example of a method for controlling the amount of fuel to be injected in the embodiment of the fuel injection system of the present invention shown in FIG. 5.

FIG. 5 is a block diagram showing a fuel injection system for an internal combustion engine which is another embodiment of the present invention and FIG. 6 is a flow chart showing an example of a control method carried out in the fuel injection system shown in FIG. 5.

In the embodiment as shown in FIGS. 5 and 6, the target value is calculated by the L-jetronic method under an engine operating condition where the pressure Pn is less than a predetermined pressure P01 and is calculated by the D-jetronic method under an engine operating condition where the pressure Pn is more than a predetermined pressure P02 and the correcting operation for gradually changing the amount of fuel to be injected is carried out only in a case where the pressure Pn changes from a pressure less than the predetermined pressure P01 or a pressure more than the predetermined pressure P02 to a pressure between the predetermined pressure values P01 and P02, and is not carried out in a case where the pressure Pn changes between a pressure less than the predetermined pressure P01 to a pressure more than the predetermined pressue P02. In the previous embodiments, even in a case where the driver operates the acceleration pedal for rapid acceleration, if the pressure Pn changes from a pressure less than the predetermined pressure P0 to a pressure equal to the predetermined pressure P0 or more, or from a pressure equal to the predetermined pressure P0 or more to a pressure less than the predetermined pressure P0, the amount of fuel to be injected is always controlled so as to gradually change from the target value calculated by one method at the control cycle just before the change of the calculating method and that calculated by the other method at the control cycle just after the change of the calculation method in the predetermined time and, therefore, the response during rapid acceleration is poor. The embodiment shown in FIG. 5 overcomes problem.

In the embodiment shown in FIG. 5, there are provided in the fuel injection system a first pressure determining means 31 for judging whether a pressure Pn at the portion downstream of the throttle valve 9 is less than the predetermined pressure P01, a second pressure determining means 32 for judging whether the pressure Pn is more than the predetermined pressure P02, a L-jetronic calculating means 33 for calculating the target value by the L-jetronic method, a D-jetronic calculating means 34 for calculating the target value by the D-jetronic method, a target value correcting means 35 for correcting the target value when the pressure Pn changes from a value less than the predetermined pressure P01 to a value between the predetermined pressures P01 and P02 or the pressure Pn changes from a value more than the predetermined pressure P02 to a value between the predetermined pressures P01 and P02, a fuel injection valve control means 36 and a fuel injection valve 10. The first pressure determining means 31 receives the output signal representing the pressure Pn at the portion downstream of the throttle valve 9 from the boost sensor 16 and judges whether or not the pressure Pn is less than the predetermined pressure P01. If the pressure Pn is less than the predetermined pressure P01, the first pressure determining means 31 produces a first command signal and outputs it to the L-jetronic calculating means 33 and if it is not, it produces a second command signal and outputs it to the second pressure determining means 32. The second pressure determining means 32 receives the output signal representing the pressure Pn from the boost sensor 16 and judges whether or not the pressure Pn is more than the predetermined pressure P02 only when it further receives the second command signal from the first pressure determining means 31. If the second pressure determinging means 32 judges that the pressure Pn is more than the predetermined pressure P02, it produces a third command signal to output it to the D-jetronic calculating means 34, while otherwise, the second pressure determining means 32 produces a fourth command signal and outputs it to the target value correcting means 35. The target value correcting means 35 receives and stores the output signal representing the pressure Pn from the boost sensor 16 during each control cycle and only when it receives the fourth command signal from the second pressure determining means 32, it produces fifth and sixth command signals and outputs them to the L-J calculating means 33 and the D-J calculating means 34, respectively. Then, the target value correcting means judges whether or not the pressure Pn-1 received and stored therein in the preceding control cycle is less than the predetermined pressure P01. If the target value correcting means 35 judges that the pressure Pn-1 in the preceding control cycle was less than the predetermined pressure P01, since this means that the amount of fuel to be injected was calculated by the L-jetronic method in the preceding control cycle, it carries out a first correcting operation to calculate the amount of fuel to be injected in the correcting operation cycle and if it was not less, since this means that the amount of fuel to be injected was calculated by the D-jetronic method in the preceding control cycle, it carries out a second correcting operation to calculate the amount of fuel to be injected in the correcting operation cycle. The L-jetronic calculating means 33 receives the output signals from the air flow meter 8 and the engine rpm sensor 17 and calculates the target value by the L-jetronic method only when it receives the first command signal from the first pressure determining means 31 or the fifth command signal from the target value correcting means 35. The D-jetronic calculating means 34 and the boost sensor 16 and calculates the target value by the D-jetronic method only when it receives the third command signal from the second pressure determining means 32 or the sixth command signal from the target value correcting means 35. The fuel injection valve control means 36 receives a control signal representing the amount of fuel to be injected from the L-jetronic calculating means 33, the D-jetronic calculating means 34 or the target value correcting means 35 and controls the opening period of the fuel injection valve 10 in accordance with the control signal.

In FIG. 6, an amount of intake air Qn, an engine rpm Nn and a pressure Pn detected by the boost sensor 16 are read in respectively and then the first pressure determining means 31 judges whether the pressure Pn is less than the predetermined pressure P01.

If the first pressure determining means 31 judges that the pressure Pn is less than the predetermined pressure P01, it produces the first command signal and outputs it to the L-jetronic calculating means 33. When the L-jetronic calculating means 33 receives the first command signal from the first pressure determining means 31, it uses the L-jetronic method to calculate a standard amount TL0n of fuel to be injected and corrects it using the various correction coefficients to obtain a target value TLn of an amount of fuel to be injected and outputs the target value TLn as the target value Tn in the same manner as in the previous embodiments. After outputting a control signal representing the target value TLn to the fuel injection valve control means 36 to control the opening period of the fuel injection valve 10, the control operation returns to the start.

On the other hand, if the first pressure determining means 31 judges that the pressure Pn is not less than the predetermined pressure P01, it produces the second command signal and outputs it to the second pressure determining means 32. When the second pressure determining means 32 receives the second command signal, it judges whether the pressure Pn is more than the predetermined pressure P02.

As a result, if the second pressure determining means 32 judges that the pressure Pn is more than the predetermined pressure P02, it produces the third command signal and outputs to the D-jetronic calculating means 34. When the D-jetronic calculating means 34 receives the third command signal from the second pressure determining means 32, it calculates the target value TDn by the D-jetronic method in the same manner as in the previous embodiments. More specifically, a standard amount TD0n of fuel to be injected is calculated based upon mapped amounts F(Nn,Pn) of fuel to be injected experimentally determined as a function of the engine rpm Nn and the pressure Pn detected by the boost sensor 16, and the mapped values being stored in the D-jetronic calculating means 34, and upon the intake air temperature coefficient Cai and is corrected using various correction coefficients conventionally to calculate a target value TDn of the amount of fuel to be injected in the same manner as in the previous embodiments. Then, a control signal representing the target value TDn is output as the target value Tn to the fuel injection value control means 36 to control the opening period of the fuel injection valve 10, whereafter the control operation returns to the start.

On the other hand, if the second pressure determining means 32 judges that the pressure Pn is not more than the predetermined pressure P02, it produces the fourth command signal and outputs it to the target value correcting means 35. When the target value correcting means 35 receives the fourth command signal from the second pressure determining means 32, it produces the fifth command signal and outputs it to the L-jetronic calculating means 33 and produces the sixth command signal and outputs it to the D-jetronic calculating means 34. When the L-jetronic calculating means 33 receives the fifth command signal from the target value correcting means 35, it calculates the target value TLn by the L-jetronic metho in the same manner as described above and outputs it to the target value correcting means 35. Similarly, when the D-jetronic calculating means 34 receives the sixth command signal from the target value correcting means 35, it calculates the target value TDn by the D-jetronic method in the same manner as described above and outputs it to the target value correcting means 35. Then, the target value correcting means 35 further judges whether the pressure Pn-1 stored therein at the preceding control cycle was less than the predetermined pressure P01.

As a result, if the target value correcting means 35 judges that the pressure Pn-1 detected in the preceding control cycle was less than the predetermined pressure P01, the first correction operation starts. In this case, since it is considered that the amount of fuel injected in the preceding control cycle was calculated by the L-jetronic method, the target value Tn(j) for controlling the opening period of the fuel injection valve 10 is calculated in accordance with the following formula by correcting the target value TDn calculated by the D-jetronic method in the current correcting operation cycle using a difference between the target values TLn and TDn calculated in each control cycle so that the amount of fuel injected is gradually changed over a predetermined time period.

$$Tn(j)=TDn(j)+(TLn-TDn)/2^j$$

Next, the target value correcting means 35 outputs a control signal representing the calculated target value Tn(j) to the fuel injection valve control means 36 to control the opening period of the fuel injection valve 10 during each correcting operating cycle of the first correcting operation. This first correcting operation is repeated until a predetermined number of the correcting operation cycles are completed and a predetermined time has passed since the first correcting operation started. When the first correcting operation is completed, the control operation returns to the start and the next control cycle is started.

On the contrary, if the pressure Pn-1 detected by the boost sensor 16 in the preceding control cycle is not less than the predetermined pressure P01, a second correcting operation starts. In this case, since it is considered that the amount of fuel injected in the preceding control cycle was calculated by the D-jetronic method, the target value Tn(j) for controlling the opening period of the fuel injection valve 10 is calculated in accordance with the following formula by correcting the target value TLn(j) calculated by the L-jetronic method in the jth correcting operation cycle of the second correcting operation using a difference between the target values TLn and TDn calculated in the respective control cycles so that the amount of fuel injected is gradually changed over a predetermined time period.

$$Tn(j)=TLn(j)+(TDn-TLn)/2^j$$

Next, the target correcting means 35 outputs a control signal representing the target value Tn(j) to the fuel injection valve control means 36 to control the opening period of the fuel injection valve 10 during each correcting operation cycle of the second correcting operation. This second correcting operation is repeated until a predetermined number of the correcting cycles are completed and a predetermined time has passed since the second correcting operation started. When the second correcting operation s completed, the control operation returns to the start and the next control cycle is started.

According to the above described embodiment, since the correcting operation for gradually changing the amount of fuel to be injected is carried out only in the case where the pressure Pn changes from a pressure less than the predetermined pressure P01 or a pressure more than the predetermined pressure P02 to a pressure between the predetermined pressure values P01 and P02, it can be considered that the target value TLn or TDn calculated based upon the engine operating condition at one control cycle is close to the target value TLn-1 or TDn-1, respectively. So, even though the target value TLn and TDn are employed in place of the target values TLn-1 and TDn-1 for the correcting operation in the example, torque shock can be prevented without degrading response to rapid acceleration.

Figure 7:
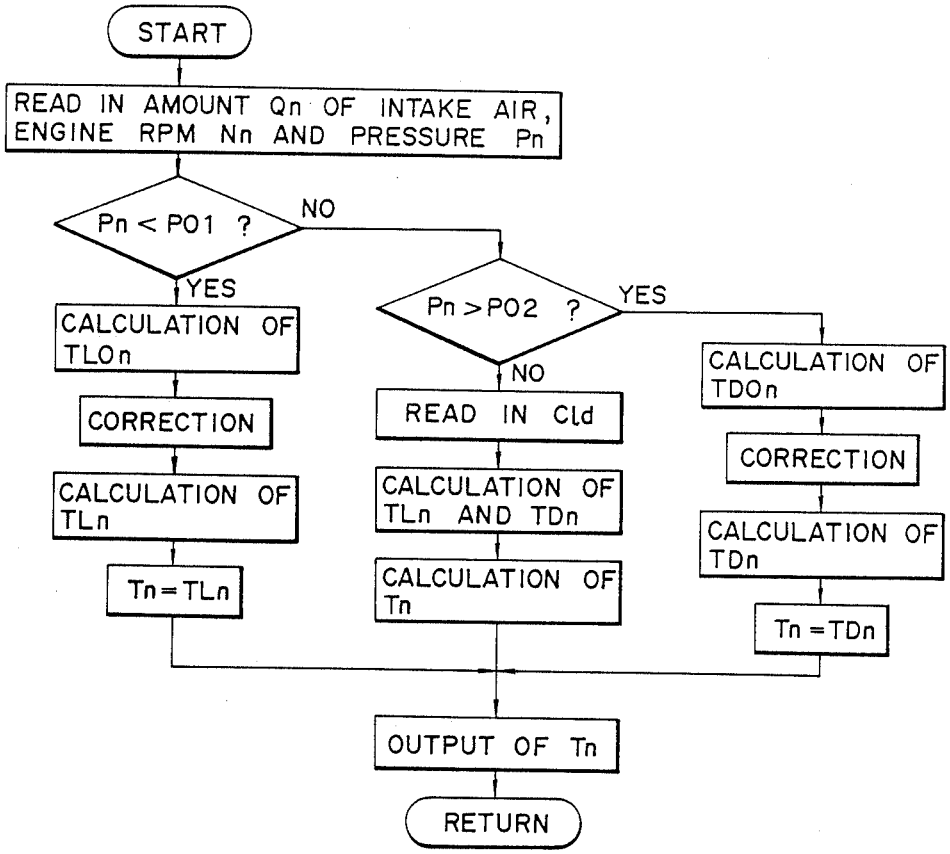
FIG. 7 is a flow chart showing another example of a method for controlling the amount of fuel to be injected in the embodiment of the fuel injection system of the present invention shown in FIG. 5.

The flow chart of FIG. 7 shows another example of a control method in the fuel injection system for internal combustion engine shown in FIG. 5.

The example shown in FIG. 7 provides a fuel injection system for an internal combustion engine capable of preventing torque shock with a simple structure. In this method, three calculating methods for calculating an amount of fuel to be injected are selectively employed in accordance with the pressure Pn at the portion downstream of the throttle valve 9. More specifically, the target value is calculated by the L-jetronic method under an engine operating condition A where the pressure Pn is less than a predetermined pressure P01 and is calculated by the D-jetronic method under an engine operating condition B where the pressure Pn is more than a predetermined pressure P02. Under an engine operating condition C where the pressure Pn is between the predetermined pressure P01 and P02, the target value for controlling the amount of fuel to be injected is determined by a third calculating method by which the amount of fuel to be injected is determined depending upon the pressure Pn and target values TLn and TDn calculated in accordance with the engine operating condition by the L-jetronic method and the D-jetronic method so that the target value calculated by the third calculating method id between the target values TLn and TDn calculated in accordance with the engine operating condition by the L-jetronic method and the D-jetronic method and that the amount of fuel to be injected can be prevented from suddenly changing in response to changes in the engine operating condition. According to this example, since the third calculating method is determined as described above and when engine operating condition changes from that where one of the L-jetronic method and the D-jetronic method can calculate the amount of fuel to be injected with higher accuracy to that where the other method can calculate the amount of fuel to be injected with higher accuracy, if the pressure Pn is between P01 and P02, the target value is calculated by the third calculating method which provide the target value between those calculated by the L-jetronic method and the D-jetronic method without being calculated by the other calculating method, the target value for controlling the amount of fuel to be injected can be smoothly changed as engine operating condition changes without carrying out any correcting operation and therefore, it is not necessary to provide means such as a timer for measuring a correcting operation time and torque shock can be effectively prevented with a simple configuration.

To carry out the control method shown in FIG. 7, using the fuel injection system shown in FIG. 5, it suffices merely to modify the function of the target value correcting means 35. More specifically, similarly to the preceding example, the target value correcting means 35 produces the fifth and sixth command signal and outputs them to the L-jetronic calculating means 33 and the D-jetronic calculating means 34, respectively, when it receives the fourth command signal from the second pressure determining means 32. The L-jetronic calculating means 33 calculates the target value by the L-jetronic method and outputs it to the target value correcting means 35 and the D-jetronic calculating means 34 calculates the target value by the D-jetronic method and outputs it to the target value correcting means 35. When the target value correcting means 35 receives the target values from the L-jetronic calculating means 33 and the D-jetronic calculating means 34, it starts calculating the target value for controlling the amount of fuel to be injected by the third calculating method, without judging whether or not the pressure Pn-1 detected by the boost sensor 16 in the preceding control cycle was less than the predetermined pressure P01. After calculating the target value using a map stored therein, it outputs a control signal representing the target value to the fuel injection valve control means 36 to control the opening period of the fuel injection valve 10.

Referring to FIG. 7, similarly to the preceding example shown in FIG. 6, an amount of intake air Qn, an engine rpm Nn and a pressure Pn detected by the boost sensor 16 are respectively read in and then the first pressure determining means 31 judges whether the pressure Pn is less than the predetermined pressure P01.

If the first pressure determining means 31 judges that the pressure Pn is less than the predetermined pressure P01, it produces the first command signal and outputs it to the L-jetronic calculating means 33. When the L-jetronic calculating means 33 receives the first command signal from the first pressure determining means 31, it uses the L-jetronic method to calculate a standard amount TL0n of fuel to be injected and corrects it using the various correction coefficients to obtain a target value TLn of an amount of fuel to be injected in the same manner as in the previous embodiments. After outputting a control signal representing the target value TLn to the fuel injection valve control means 36 to control the opening period of the fuel injection valve 10, the control operation returns to the start.

On the other hand, if the first pressure detecting means 31 judges that the pressure Pn is not less than the predetermined pressure P01, it produces the second command signal and outputs it to the second pressure determining means 32. When the second pressure determining means 32 receives the second command signal, it judges whether the pressure Pn is more than the predetermined pressure P02.

As a result, if the second pressure determining means 32 judges that the pressure Pn is more than the predetermined pressure P02, it produces the third command signal and outputs it to the D-jetronic calculating means 34. When the D-jetronic calculating means 34 receives the third command signal from the second pressure determining means 32, it calculates the target value by the D-jetronic method in the same manner as in the previous embodiments. More specifically, a standard amount TD0n of fuel to be injected is calculated based upon mapped amounts F(Nn,Pn) of fuel to be injected experimentally determined as a function of the engine rpm Nn and the pressure Pn detected by the boost sensor 16, the mapped amounts being stored in the D-jetronic calculating means 34, and upon the intake air temperature coefficient Cai, and is corrected using various correction coefficients conventionally to calculate a target value TDn of an amount of fuel to be injected in the same manner as in the previous embodiments. And then, a control signal representing the target value TDn is output to the fuel injection valve control means 36 to control the opening period of the fuel injection valve 10, whereafter the control operation returns to the start.

On the other hand, if the second pressure determining means 32 judges that the pressure Pn is not more than the predetermined pressure P02, it produces the fourth command signal and outputs it to the target value correcting means 35. When the target value correcting means 35 receives the fourth command signal from the second pressure determining means 32, if produces the fifth command signal and outputs it to the L-jetronic calculating means 33, and produces the sixth command signal and outputs it to the D-jetronic calculating means 34. When the L-jetronic calculating means 33 receives the fifth command signal from the target value correcting means 35, it calculates the target value TLn by the L-jetronic method in the same manner as described above and outputs it to the target value correcting means 35. Similarly, when the D-jetronic calculating means 34 receives the sixth command signal from the target value correcting means 35, it calculates the target value TDn by the D-jetronic method in the same manner as described above and outputs it to the target value correcting means 35.

Figure 8:
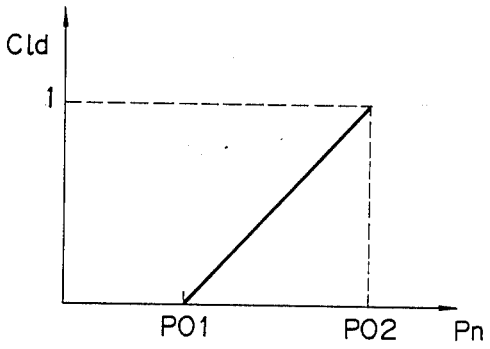
FIG. 8 is a graph showing an example of a map for determining a target value determining coefficient in the control method shown in FIG. 7.

When the target value correcting means 35 further receives the target values TLn and TDn from the L-jetronic calculating means 33 and the D-jetronic calculating means 34, it starts calculating the target value for controlling the amount of fuel to be injected in the current control cycle. The target value correcting means 35 stores a map of target value determining coefficients Cld experimentally determined in advance as a function of the pressure Pn at the portion downstream of the throttle valve 9. FIG. 8 shows an example of a map of target value determining coefficients Cld in which the target value determining coefficient Cld changes linearly between the predetermined pressures P01 and P02. The target value correcting means 35 reads out the target value determining coefficient Cld from the map, whereafter the target value Tn for controlling the amount of fuel to be injected is calculated as a weighted mean of the target values TLn and TDn in accordance with the following formula and a control signal representing the target value Tn is sent to the fuel injection valve 10. The control operation then returns to the start.

$$Tn=(1-Cld)\times TLn+Cld\times TDn$$

By this example of the control method, it is possible with a simple configuration to control the amount of fuel to be injected in a desired manner and to effectively prevent torque shock.

Figure 9:
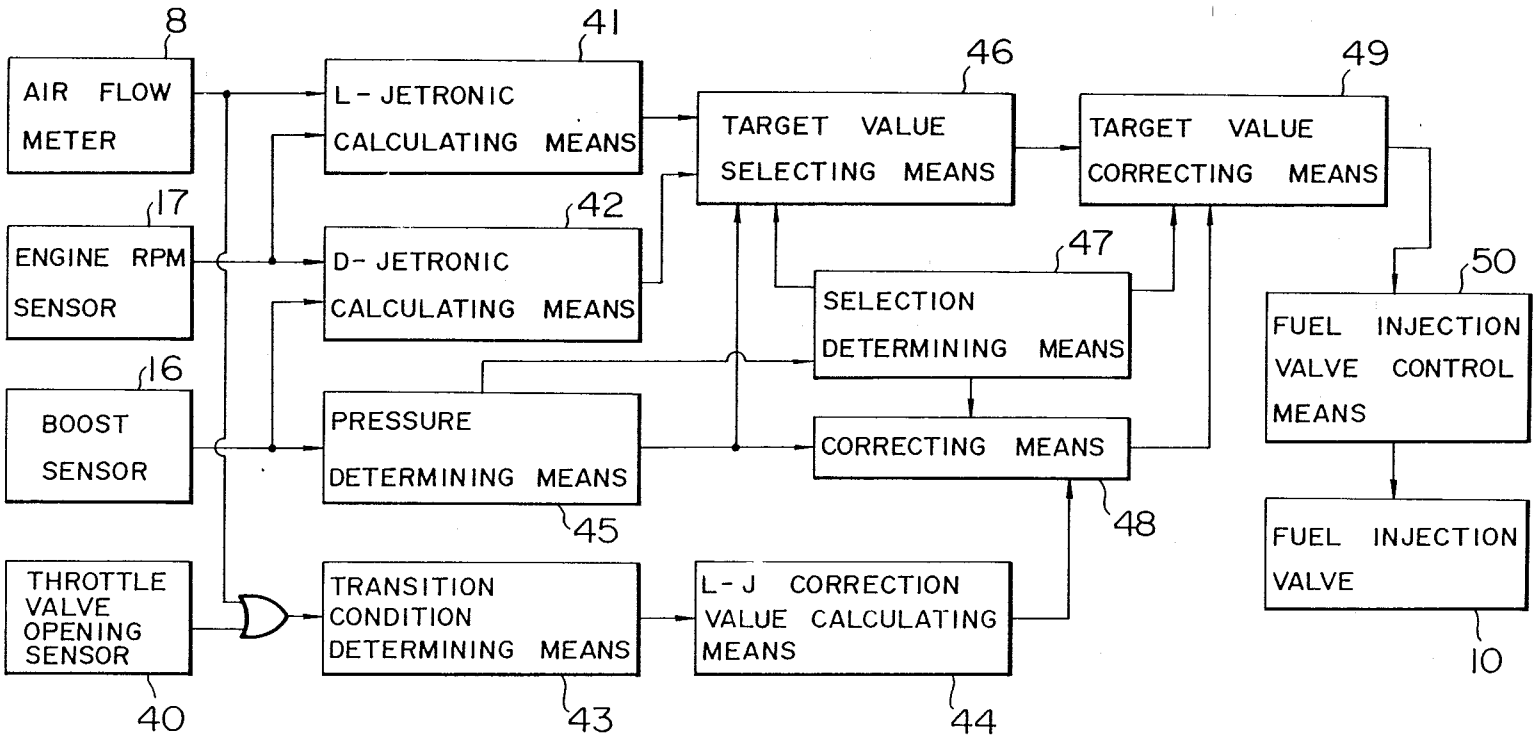
FIG. 9 is a block diagram showing a fuel injection system for an internal combustion engine which is a further embodiment of the present invention.

The block diagram of FIG. 9 shows a fuel injection system for an internal combustion engine which is a further embodiment of the present invention.

The embodiment shown in FIG. 9 makes it possible to control the amount of fuel to be injected so as to obtain the optimum air-fuel ratio during transient engine operating conditions. During transient engine operating condition, since the response of a fuel injection system to a change in engine operating condition is inevitably delayed, the amount of fuel injected is always one calculated based on an engine operating condition some time earlier. To avoid this problem, it might be considered to correct the amount of fuel to be injected so that it is greater than the calculated value during an acceleration and less than the calculated value during a deceleration. However, in a fuel injection system in which both the L-jetronic method and the D-jetronic method are employed for calculating the amount of fuel to be injected in accordance with the engine operating condition, there is a considerable difference between the correction values calculated by the L-jetronic method and the D-jetronic method for correcting the calculated amount of fuel to be injected during an acceleration or deceleration. Therefore, when acceleration or deceleration causes the engine operating condition to change between that where the amount of fuel to be injected is calculated by the L-jetronic method and that where the amount of fuel to be injected is calculated by the D-jetronic method, it is difficult to correct the calculated amount of fuel to be injected in such manner that air-fuel ratio can be controlled to the optimum value. This embodiment provides a solution to this problem.

In addition to the components of the embodiment shown in FIGS. 1 and 2, the engine system in FIG. 9 is provided with a throttle valve opening sensor 40 for detecting the opening of the throttle valve 9. For the fuel injection system shown in FIG. 9, there are provided a L-jetronic calculating means 41 for calculating a target value by the L-jetronic method based upon signals output from the air flow meter 8 and the engine rpm sensor 17, a D-jetronic calculating means 42 for calculating a target value by the D-jetronic method based upon signals output from the engine rpm sensor 17 and the boost sensor 16, a transition condition determining means 43 for determining whether or not the engine is accelerating or decelerating based upon signals output from the air flow meter 8 and the throttle valve opening detecting means 40, a L-jetronic correctin value calculating means 44 (hereinafter referred to as a L-J correction value calculating means) for calculating a correction value (hereinafter referred to as a L-J correction value) for correcting the target value calculated by the L-jetronic calculating means 41 during an acceleration or deceleration based upon a signal output from the transition condition determining means 43 and a map or table experimentally determined and stored therein for determining the L-J correction value in accordance with the degree of acceleration or deceleration, a pressure determining means 45 for judging whether or not the pressure Pn detected by the boost sensor 16 is less than the predetermined pressure P0, a target value selecting means 46 for selecting one or both of the target values calculated by the L-jetronic calculating means 41 and the D-jetronic calculating means 42 based upon a signal output from the pressure determining means 44, a selection determining means 47 for determining whether or not the pressure Pn detected by the boost sensor 16 changes between consecutive cycles from a pressure less than the predetermined pressure P0 to a pressure greater than P0 or from a pressure greater than P0 to a pressure less than P0, a correcting means 48 for outputting to the target value correcting means 49 the L-J correction value received from the L-J correction value calculating means 44 and/or a correction value (hereinafter referred to as a D-J correction value) for correcting for correcting the standard target value TD0n calculated by the D-jetronic method in accordance with the engine operating condition. More specifically, it corrects the L-J correction value to calculate the D-J correction value and if $(Pn-P0)\times(Pn\text{-}1-P0)$ is less than zero, it outputs the L-J and D-J correction values to the target value correcting means 49 and if $(Pn-P0)\times(Pn\text{-}1-P0)$ is not less than zero and the output signal from the pressure determining means 45 shows that the pressure Pn is less than the predetermined pressure P0, it outputs only the L-J correction value to the target value correcting means 49 without further correcting and if $(Pn-P0)\times(Pn\text{-}1-P0)$ is not less than zero and the output signal from the pressure determining means 45 shows that the pressure Pn is not less than the predetermined pressure P0, it outputs only the D-J correction value to the target value correcting means 49.

Figure 10A:
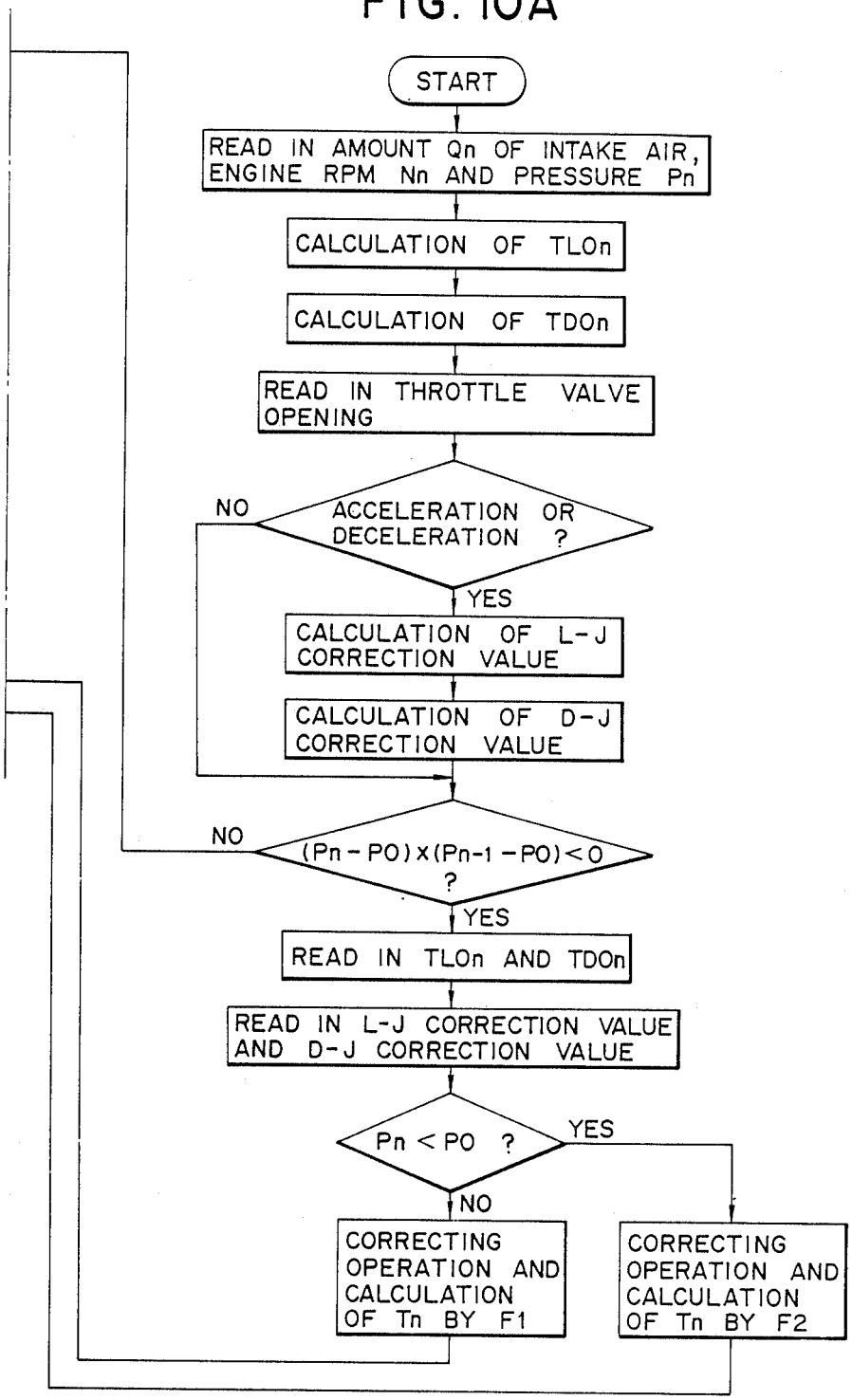
FIGS. 10, 10A, and 10B are a flow chart showing an example of a method for controlling the amount of fuel to be injected in the embodiment of the fuel injection system of the present invention shown in FIG. 9.
Figure 10B:
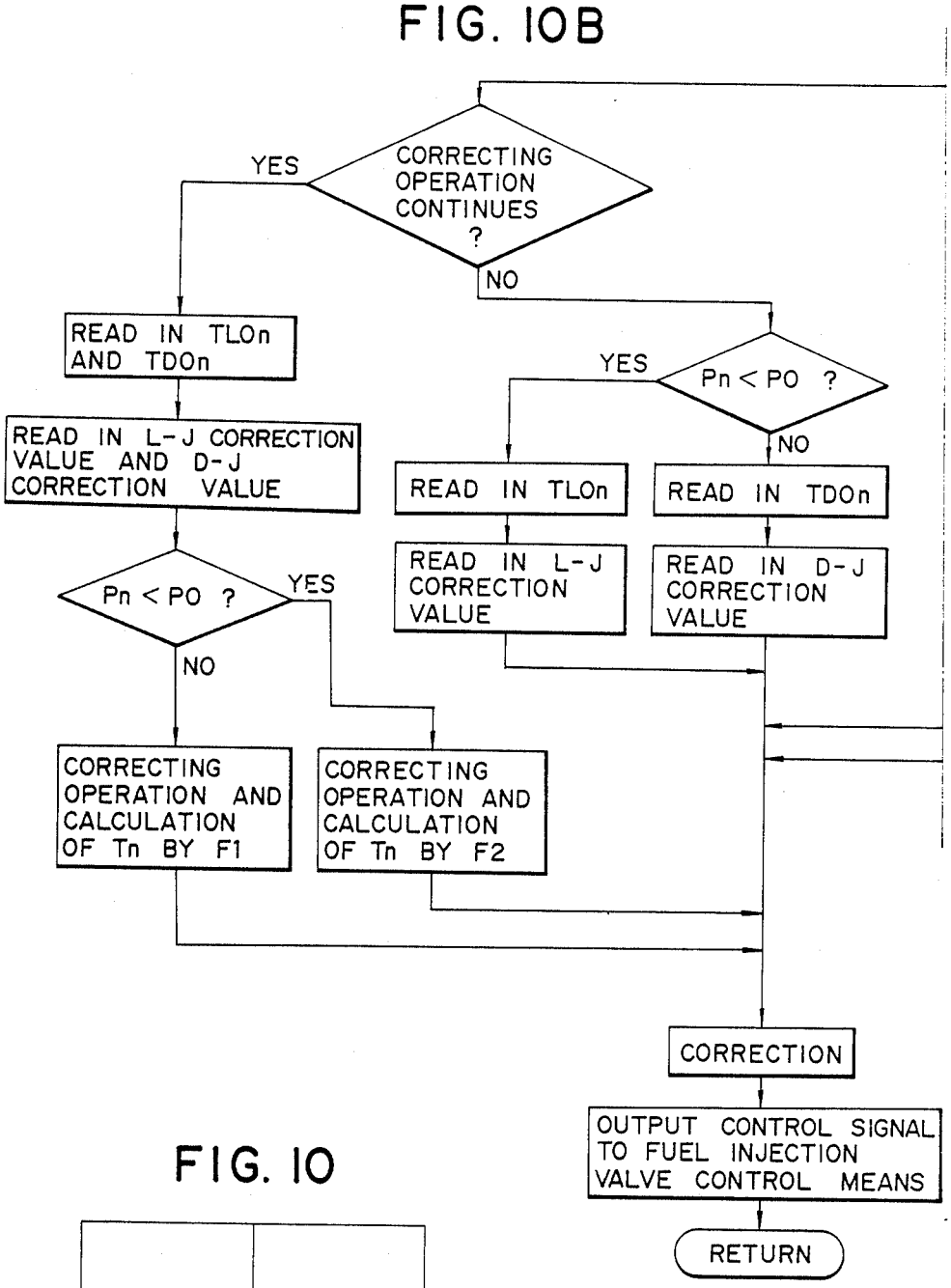
Figure 10:
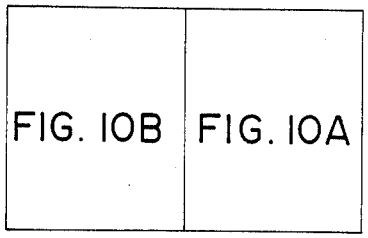

FIG. 10 is a flow chart showing an example of a control method in the fuel injection system shown in FIG. 9.

Referring to FIGS. 9 and 10, a signal representing an amount Qn of intake air detected by the air flow meter 8, a signal representing an engine rpm Nn detected by the engine rpm sensor 17, a signal representing a pressure Pn at the portion downstream of the throttle valve 9 detected by the boost sensor 16 and a signal representing an opening of the throttle valve 9 detected by a throttle valve opening sensor 40 are respectively input to the fuel injection system provided in the control unit 20.

The L-jetronic calculating means 41 calculates a standard target value TL0n for controlling the amount of fuel to be injected by the L-jetronic method based upon the input amount Qn of intake air and the input engine rpm Nn and the D-jetronic calculating means 42 calculates a standard target value TD0n by the D-jetronic method on the basis of the input engine rpm Nn and the input pressure Pn. The transition condition determining means 43 calculates the rate of change of the amount Qn of intake air based upon the signal received from the air flow meter 8 and/or the rate of cnage of the opening of the throttle valve 9 based upon the signal received from the throttle valve opening sensor 40 to judge whether the engine is accelerating or decelerating or operating steadily, and outputs a signal representing the result of the judgment to the L-J correction value calculating means 44. The L-J correction value calculating means 44 calculates a L-J correction value for correcting the target value TL0n calculated by the L-jetronic calculating means 41 and outputs it to the correcting means 48 in accordance with the signal output from the transition condition determining means 43, wherein the L-J correction value is set to be zero under steady engine operating condition.

On the other hand, the pressure determining means 45 judges whether or not the pressure Pn is less than the predetermined value P0 and outputs a signal representing the result of the judgment to the selection determining means 47, the target value selecting means 46 and the correcting means 48, respectively.

The selection determining means 47 judges whether or not the pressure Pn detected by the boost sensor 16 has changed between the preceding control cycle and the current control cycle from a pressure less than the predetermined pressure P0 to a pressure greater than P0 or from a pressure greater than P0 to a pressure less than P0 based upon the output signal from the pressure determining means 45 in the current control cycle and that in the preceding control cycle stored therein, i.e. it determines whether $(Pn-P0)\times(Pn\text{-}1-P0)$ is less than zero or not, and outputs a signal representing the result of the judgement to the target value selecting means 46, the correcting means 48 and the target value correcting means 49, respectively.

If the output signal from the selection determining means 47 indicates YES, i.e. if $(Pn-P0)\times(Pn\text{-}1-P0)$ is less than zero, the calculating method selecting means 46 outputs the standard target value TL0n output from the L-jetronic calculating means 41 and the standard target value TD0n output from the D-jetronic calculating means 42 to the target value correcting means 49. On the contrary, if $(Pn-P0)\times(Pn\text{-}1-P0)$ is not less than zero and the output signal from the pressure determining means 45 indicates that the pressure Pn is less than the predetermined pressure P0, the target value selecting method 46 selects the output TL0n from the L-jetronc calculating means 41 as the standard target value and outputs it to the target value correcting means 49, and if $(Pn-P0)\times(Pn\text{-}1-P0)$ is not less than zero and the output signal from the pressure determining means 45 indicates that the pressure Pn is not less than the predetermined pressure P0, it selects the output TD0n from the D-J calculating means 42 as the standard target value and outputs it to the target value correcting means 49.

The correcting means 48 outputs the L-J correction value output from the L-J correction value calculating means 44 and a D-J correction value obtained by correcting the L-J correction value to the target value correcting means 49 if the output signal from the selection determining means 47 indicates YES, i.e. if $(Pn-P0)\times(Pn\text{-}1-P0)$ is less than zero. On the contrary, if the output signal from the selection determining means 47 indicates NO and the output signal from the pressure determining means 45 indicates that the pressure Pn is less than the predetermined pressure P0, the correcting means 48 outputs only the L-J correction value without further correcting and if the output signal from the selection determining means 47 indicates NO and the output signal from the pressure determining means 45 indicates that the pressure Pn is not less than the predetermined pressure P0, it outputs only the D-J correction value obtained by correcting the L-J correction value to target value correcting means 49, respectively.

Further, the target value correcting means 49 receives the output signals from the target value selecting means 46, the correcting means 48 and the selection determining means 47 and corrects the standard target value TL0n or TD0n output from the target value selecting means 46 with the L-J or D-J correction value output from the correcting means 48 to calculate a target value Tn for controlling the amount of fuel to be injected if the output signal from the selection determining means 47 indicates NO, i.e. if $(Pn-P0)\times(Pn\text{-}1-P0)$ is not less than zero, and outputs a control signal produced based upon the calculated target value Tn to the fuel injection valve control means 50 to control the opening period of the fuel injection valve 10, whereafterthe operation returns to the start.

On the other hand, if the output signal from the selection determining means 47 indicates YES, i.e. if $(Pn-P0)\times(Pn\text{-}1-P0)$ is less than zero, the target value correcting means 49 starts a correcting operation and calculates a target value Tn for controlling the amount of fuel to be injected by a correcting formula determined depending upon whether the pressure Pn is less than the predetermined pressure P0 or not, so that the target value Tn is changed gradually over a predetermined time from a target value calculated by a calculating method selected for calculating a target value in the preceding control cycle in accordance with the engine operating condition in this cycle to a target value calculated based upon the target values TL0n or TD0n output from the target value selecting means 46 or the L-J and D-J correction values.

When the target value calculating method changes from the L-jetronic method to the D-jetronic method between the preceding control cycle and the current control cycle, according to one the example, the target value Tn can be corrected using the following formula F1 and the corrected target value is obtained as a weighted means of the target value TL0n calculated by the L-jetronic method and corrected by the L-J correction value al and the target value TD0n calculated by the D-jetronic method and corrected by the D-J correction value ad.

$$Tn=(1-k)(TL0n+al)+k(TD0n+ad)$$

wherein k is a coefficient which is a function of time and which is changed from zero to 1 over a predetermined time. As one example, k may be selected so that it linearly changes from zero to 1 over the predetermined time i.e. the correcting operation time. Since the target values TL0n and TD0n, and the correction values al and ad are also functions of time, the target value TL0n and TD0n, and the correction value al and ad are reset to values calculated in accordance with the engine operating condition at each instant during the correcting operation so that the target value calculated in accordance with the above correcting formula F1 after the predetermined time has passed can converge to the target value calculated by the D-jetronic method at the time when the correcting operation is completed.

On the other hand, when the target value calculating method changes from the D-jetronic method to the L-jetronic method between the preceding control cycle and the current control cycle, according to one example, the target value Tn can be calculated in accordance with the following formula F2.

$$Tn=(1-k)(TD0n+ad)+k(TL0n+al)$$

Further, when the target value calculating method changes from the L-jetronic method to the D-jetronic method between one control cycle and the preceding control cycle and the target value calculating method further changes from the D-jetronic method to the L-jetronic method as the engine operating condition changes during the correcting operation by the formula F1 in the one control cycle, the correcting operating is carried out in accordance with the formula F2 after the calculating method changes. And similarly, when the target value calculating method changes from the D-jetronic method to the L-jetronic method between one control cycle and the preceding control cycle and the target value calculating method further changes from the L-jetronic method to the D-jetronic method as the engine operating condition changes during the correcting operation by the formula F2 in the one control cycle, the correcting operation is carried out in accordance with the formula F1 after the calculating method changes.

The target value correcting means 49 outputs a control signal produced on the basis of the corrected target value Tn to the fuel injection valve control means 50 to control the opening period of the fuel injection valve 10 in each cycle of the correction operation. When the correcting operation is completed, the control operation returns to the start.

Although not specified in the above described embodiment, it is a matter of course that before the control signal is outputted to the fuel injection valve control means 50, conventional corrections such as corrections using the intake air temperature, cooling water temperatures etc. in the same manner as described in the previous embodiments.

According to the above described embodiment, even during acceleration or deceleration, it is possible to control the air-fuel ratio to an optimum value when the target value calculating method changes between the L-jetronic method and the D-jetronic method in response to changes in the engine operating condition.

As described above, according to the present invention, it is possible to control the air-fuel ratio to the optimum value when the calculating method for calculating the amount of fuel to be injected changes between the L-jetronic method and the D-jetronic method in response to the engine operating condition, even during acceleration or deceleration.

The present invention has thus been shown and described with reference to specific embodiments. However, it should be noted that the present invention is in no way limited to the details of the described arrangements but changes and modifications may be made without departing from the scope of the appended claims.

For example, although a target value calculating method is selected in accordance with the engine load in the above described embodiment, it may be selected in accordance with the amount of intake air in place of the engine load. In the case, the target value determining coefficient Cld employed in the example as shown in FIG. 7 is determined as a function of the amount of intake air.

Further, although the boost sensor 16 is employed as an engine load detecting means in the above described embodiments, a throttle valve opening sensor for detecting the opening of the throttle valve 9 may be employed in place of the boost sensor 16.

Further, although in the example shown in FIG. 3, a target value is corrected based upon a target value calculated in the preceding control cycle and a target value calculated in the control cycle just after the calculating method changed between the L-jetronic method and the D-jetronic method and in the examples shown in FIGS. 4, 6, 7 and 10, the amount of fuel to be injected in the control cycle is corrected based upon a target value calculated by the calculating method employed in the preceding control cycle and the target value calculated by the calculating method employed in the control cycle in accordance with the engine operating condition in the control cycle, since there is generally no great difference between the target value calculated in accordance with the engine operating condition in the preceding control cycle and that calculated in accordance with the engine operating condition in the control cycle insofar as the target value is calculated by the same calculating method, the correcting operation can be carried out based upon either of the target values.

Furthermore, although the correcting operation is carried out by correcting a target value calculated by one of the L-jetronic method and the D-jetronic method using a difference between the calculated values by the two methods when the calculating method is changed in the example shown in FIGS. 3, 4 and 6, the correcting operation may be carried out by calculating a weighted mean of the target values calculated by the L-jetronic method and the D-jetronic method using a coefficient which is a function of time.

Further, although the correction value for correcting the target value calculated by the D-jetronic method during acceleration or deceleration is calculated by correcting the correction value for correcting the target value calculated by the L-jetronic method in the example shown in FIG. 10, in contrast with this, the correction value for correcting the target value calculated by the L-jetronic method during acceleration or deceleration may be calculated by correcting the correction value for correcting the target value calculated by the D-jetronic method, and the respective correction values may be calculated by independent means.

Moreover, it should be noted that the respective means described in the block diagrams shown in FIGS. 2, 5 and 9 need not necessarily be physical devices but that it is sufficient that the predetermined operations can be carried out in the fuel injection system as a whole. For examples, such operations may be carried out by a computer program.

We claim:

1. A fuel injection system for an internal combustion engine having an air flow meter provided in an intake passage for detecting an amount of intake air, engine load detecting means for detecting an engine load based upon a pressure at a portion downstream of a throttle valve in the intake passage or an opening of the throttle valve, and engine rpm detecting means, said fuel injection system comprises fuel injecting means, first calculating means for calculating an amount of fuel to be injected by said fuel injecting means based upon an output from said air flow meter under an engine operating condition where the amount of intake air is small, second calculating means for calculating an amount of fuel to be injected by said fuel injecting menas based upon outputs from said engine load detecting means and said engine rpm detecting means under an engine operating condition where the amount of intake air is large, and correcting means for correcting said amount of fuel to be injected upon switchover between said first and second calculating means in response to changes in the engine operating condition, whereby the difference between successive amounts of fuel to be injected is never large.

2. A fuel injection system for an internal combustion engine in accordance with claim 1 in which said correcting means corrects the amount of fuel to be injected based upon a difference between calculated values calculated by said first and second calculating means in accordance with an engine operating condition at the time when the calculating means is switched over between said first and second calculating means.

3. A fuel injection system for an internal combustion engine in accordance with claim 1 in which said correcting means corrects the amount of fuel to be injected so as to be a weighted mean of calculated values calculated by said first and second calculating means in accordance wtih an engine operating condition at the time when the calculating means is switched over between said first and second calculating means calculated using a predetermined function.

4. A fuel injection system for an internal combustion engine in accordance with claim 1 in which said correcting means corrects the amount of fuel to be injected calculated by either of the first or second calculating means selected in accordance with an engine operating condition just after the calculating method is switched over between said first and second calculating means.

5. A fuel injection system for an internal combustion engine in accordance with claim 1 which further includes transient condition correcting means for correcting the amount of fuel to be injected calculated by said first calculating means and/or said second calculating means during acceleration or deceleration and in which said correcting means corrects the amount of fuel to be injected corrected by said transient condition correcting means.

6. A fuel injection system for an internal combustion engine in accordance with claim 3 in which said predetermined function is a function of time.

7. A fuel injection system for an internal combustion engine in accordance with claim 3 in which said predetermined function is a function of an amount of intake air or an engine load.

8. A fuel injection system for an internal combustion engine in accordance with claim 7 which further includes transient condition correcting means for correcting the amount of fuel to be injected calculated by said first calculating means and/or said second calculating means during acceleration or deceleration and in which said correcting means corrects the amount of fuel to be injected corrected by said transient condition correcting means.

9. A fuel injection system for an internal combustion engine in accordance with claim 4 in which said correction amount for correcting the amount of fuel to be injected by said correction means gradually approaches zero.

10. A fuel injection system for an internal combustion engine having an air flow meter provided in an intake passage for detecting an amount of intake air, engine load detecting means for detecting an engine load based upon a pressure at a portion downstream of a throttle valve in the intake passage or an opening of the throttle valve, and engine rpm detecting means, said fuel injection system comprises fuel injecting means, first calculating means for calculating an amount of fuel to be injected by said fuel injecting means based upon an output from said air flow meter under an engine operating condition where the amount of intake air is small, second calculating means for calculating an amount of fuel to be injected by said fuel injecting means based upon outputs from said engine load detecting means and said engine rpm detecting means under an engine operating condition where the amount of intake air is large and a third calculating means for calculating the amount of fuel to be injected based upon calculated values by said first calculating means and said second calculating means under an engine operating condition where the intermediate amount of intake air is introduced so as to produce the target value between those calculated by said first and second calculating means under the engine operating condition.

11. A fuel injection system for an internal combustion engine in accordance with claim 10 in which said third calculating means calculates the amount of fuel to be injected so as to be a weighted mean of calculated values calculated by said first and second calculating means in accordance with the engine operating condition using a predetermined function.

12. A fuel injection system for an internal combustion engine in accordance with claim 11 in which said predetermined function is a function of time.

13. A fuel injection system for an internal combustion engine in accordance with claim 11 in which said predetermined function is a function of an amount of intake air or an engine load.

14. A fuel injection system for an internal combustion engine in accordance with claim 13 which further includes transient condition correcting means for correcting the amount of fuel to be injected calculated by said first calculating means and/or said second calculating means during acceleration or deceleration and in which said third calculating means calculates the amount of fuel to be injected based upon the values calculated by said first and second calculating means and corrected by said transient condition correcting means.

* * * * *